US007762174B1

(12) United States Patent
Steimke et al.

(10) Patent No.: US 7,762,174 B1
(45) Date of Patent: Jul. 27, 2010

(54) AMMUNITION CONTAINER AND FEED SYSTEM

(75) Inventors: David L. Steimke, Burlington, VT (US); Parke R. Warner, Colchester, VT (US)

(73) Assignee: General Dynamics Armament and Technical Products, Burlington, VT (US)

( * ) Notice: Subject to any disclaimer, the term of this patent is extended or adjusted under 35 U.S.C. 154(b) by 530 days.

(21) Appl. No.: 11/757,066

(22) Filed: Jun. 1, 2007

(51) Int. Cl.
*F41A 9/02* (2006.01)

(52) U.S. Cl. ..... 89/33.17; 89/33.5; 89/33.02

(58) Field of Classification Search ..... 89/33.02, 89/33.17, 33.5
See application file for complete search history.

(56) References Cited

U.S. PATENT DOCUMENTS

| | | | | |
|---|---|---|---|---|
| 145,478 | A | | 12/1873 | Assmus |
| 2,069,432 | A | | 2/1937 | Watanabe |
| 2,212,687 | A | | 8/1940 | Hughes |
| 3,566,744 | A | | 3/1971 | Stoner |
| 3,584,532 | A | | 6/1971 | Stoner |
| 3,596,556 | A | | 8/1971 | Montana |
| 3,626,620 | A | | 12/1971 | Rocha |
| 3,645,165 | A | | 2/1972 | Wohlford |
| 3,667,147 | A | | 6/1972 | Goldin |
| 3,670,442 | A | | 6/1972 | Kennedy |
| 3,688,641 | A | | 9/1972 | Curtis |
| 3,742,636 | A | | 7/1973 | Dealy |
| 3,776,096 | A | | 12/1973 | Donovan |
| 3,783,739 | A | | 1/1974 | Perrine |
| 3,823,640 | A | | 7/1974 | Segrest |
| 3,847,054 | A | | 11/1974 | Ruger |
| 3,955,469 | A | | 5/1976 | Conley |
| 3,960,053 | A | | 6/1976 | Conley |
| 3,999,461 | A | | 12/1976 | Johnson |
| 4,019,423 | A | | 4/1977 | Johnson |
| 4,022,105 | A | | 5/1977 | White |
| 4,065,998 | A | | 1/1978 | Rocha |
| 4,066,000 | A | | 1/1978 | Rostocil |
| 4,210,060 | A | | 7/1980 | Donovan |
| 4,344,350 | A | | 8/1982 | Golden |
| 4,389,919 | A | | 6/1983 | Kast |
| 4,445,418 | A | * | 5/1984 | Sullivan et al. ..... 89/33.02 |
| 4,467,697 | A | | 8/1984 | Witt |
| 4,471,549 | A | | 9/1984 | Brint |
| 4,475,437 | A | | 10/1984 | Sullivan |
| 4,475,438 | A | | 10/1984 | Sullivan |
| 4,502,367 | A | | 3/1985 | Sullivan |
| 4,505,182 | A | | 3/1985 | Sullivan |
| 4,658,700 | A | * | 4/1987 | Sullivan ..... 89/33.02 |

(Continued)

*Primary Examiner*—Michael Carone
*Assistant Examiner*—Michael D David
(74) *Attorney, Agent, or Firm*—Hunton & Williams LLP

(57) ABSTRACT

A linkless ammunition feed system for a firearm. The ammunition feed system has an ammunition container with a path for holding a plurality ammunition rounds in a single file manner and an exit for passing the ammunition rounds out of the container. A pusher is positioned in and adapted to freely slide through the ammunition path, the plurality of ammunition rounds being positioned between the exit and the pusher, the pusher adapted to push the ammunition toward the exit. The pusher is pulled through the ammunition path by a feed line connected to the pusher and extending through the ammunition path. A rotatable feed line spool collects the feed line at the container exit, and a feed sprocket rotates to move an ammunition round from the container exit to a firearm associated with the ammunition feed system.

19 Claims, 24 Drawing Sheets

U.S. PATENT DOCUMENTS

| | | | | | |
|---|---|---|---|---|---|
| 4,677,897 | A | | 7/1987 | Barrett | |
| 4,679,486 | A | | 7/1987 | Landaas | |
| 4,760,663 | A | | 8/1988 | Zedrosser | |
| 4,765,224 | A | | 8/1988 | Morris | |
| 4,872,391 | A | | 10/1989 | Stoner | |
| 4,930,399 | A | | 6/1990 | Trevor | |
| 4,949,493 | A | | 8/1990 | Zedrosser | |
| 5,107,750 | A | * | 4/1992 | Buchstaller et al. | 89/33.17 |
| 5,147,972 | A | * | 9/1992 | Hagen et al. | 89/33.16 |
| 5,149,909 | A | * | 9/1992 | Hagen et al. | 89/33.16 |
| 5,499,569 | A | | 3/1996 | Schuetz | |
| 5,551,179 | A | | 9/1996 | Young | |
| 5,600,083 | A | * | 2/1997 | Bentley et al. | 89/33.02 |
| 5,905,224 | A | * | 5/1999 | Jordan | 89/33.02 |
| 6,044,748 | A | | 4/2000 | Westrom | |
| 6,343,536 | B1 | | 2/2002 | Rossier | |
| 6,442,882 | B1 | | 9/2002 | Dionne | |
| 6,644,168 | B1 | | 11/2003 | Brown | |
| 7,201,094 | B2 | | 4/2007 | Jebsen et al. | |
| 7,441,491 | B2 | * | 10/2008 | Snow | 89/33.02 |

* cited by examiner

AMMUNITION CONTAINER AND FEED SYSTEM

The present application claims priority to patent application Ser. No. 11/531,410, filed Sep. 13, 2006, and to provisional application No. 60/722,014, filed on Sep. 30, 2005, each of which is hereby incorporated by reference in its entirety.

FIELD OF THE INVENTION

Embodiments of the invention relate to an automatic weapon. More specifically, embodiments of the invention relate to a recoil operated automatic weapon and a linkless ammunition feed system.

BACKGROUND OF THE INVENTION

Throughout history, military forces have been employed in offensive, defensive, and peace-keeping roles. Recent events have presented a need to perform these roles in tight quarters situations set in urban environments. Accordingly, a need exists for a lightweight weapon.

Lightweight automatic firearms have been produced to meet these needs. However, many lightweight firearms are subject to reduced accuracy resulting from the repeated recoil forces to which the user is submitted when firing in an automatic mode. Therefore, a need exists for a lightweight firearm, that does not sacrifice the accuracy of heavier weapon systems.

SUMMARY OF THE INVENTION

An embodiment of the present invention provides a firearm for firing cylindrically-shaped cased telescoped or case-less ammunition. The firearm comprises a barrel having a longitudinal bore axis, and a bolt that is collinear with the barrel's bore axis and adapted for linear movement between a charged position and a firing position. The movement of the bolt is relative to the barrel and parallel to the barrel's bore axis. The firearm further comprises a chamber that has a cylindrically-shaped ammunition-holding cavity formed within. The ammunition-holding cavity has a diameter sized to receive a cylindrically-shaped round of ammunition, the ammunition-holding cavity is also collinear with the barrel's bore axis. The chamber is also adapted for linear movement between a charged position and a firing position, with linear chamber movement being relative to the barrel and collinear with the barrel's bore axis. In the charged position, the chamber is positioned rearward of and away from the barrel, the bolt is also in its charged position and a forward surface of the bolt is generally coplanar with a forward surface of the chamber, with the bolt occupying the ammunition-holding cavity. In the firing position, a forward surface of the chamber sealingly contacts a rearward surface of the barrel, the bolt is also in its firing position and a forward end of the bolt sealingly contacts a rearward end of the chamber, with the chamber ammunition-holding cavity largely vacated by the bolt.

A further embodiment of the present invention further provides a method of charging a firearm. The firearm of the method comprises a barrel with a longitudinal bore axis, and a generally cylindrically-shaped firing pin having a lug extending from a circumferential surface, a bolt comprising a generally cylindrically-shaped internal cavity, a slot extending from the internal cavity to an external surface of the bolt, and a lug extending from an exterior surface of the bolt. The internal bolt cavity is adapted to accept the firing pin and accommodate linear movement of the firing pin with the firing pin lug extending through the bolt slot. The firing pin's linear movement is relative to the bolt and parallel with the barrel's bore axis. The bolt is collinear with the bore axis and adapted for linear movement to a charged position, with the linear bolt movement being relative to the barrel and parallel to the barrel's bore axis. The firearm further comprises a chamber with a cylindrically-shaped ammunition-holding cavity formed within and having a diameter sized to receive a cylindrically-shaped round of ammunition. The ammunition-holding cavity is also collinear with the barrel's bore axis. The chamber is adapted for linear movement to a charged position, with the linear chamber movement being relative to the barrel and collinear with the barrel's bore axis. In the charged position, the chamber is positioned rearward of and away from the barrel, and the bolt is also in its charged position with a forward surface of the bolt being generally coplanar with a forward surface of the chamber and the bolt occupying the ammunition-holding cavity. The firearm further comprises a sear.

A method associated with this embodiment comprises moving the chamber rearward, away from the barrel and overriding the bolt, until a rearward surface of the chamber contacts the firing pin lug. With the chamber continuing to move rearward, it begins to push on the firing pin lug and push the firing pin rearward toward a rearward end of the bolt cavity, while continuing to override the bolt. The chamber and firing pin continue rearward until a rearward surface of the chamber contacts the bolt lug, at the same time, the forward surface of the bolt is generally coplanar with the forward surface of the chamber, and the firing pin stops moving relative to the bolt. Finally, the chamber and firing pin continue rearward while pushing on the bolt lug and pushing the bolt rearward until the firing pin lug catches on the sear.

Yet another embodiment of the present invention provides a method of firing a round of cased telescoped or case-less ammunition from a firearm. The firearm of this method comprises a barrel having a longitudinal bore axis, a bolt that is collinear with the bore axis and adapted for linear movement between a charged position and a firing position, with the linear bolt movement being relative to the barrel and parallel to the bore axis, and a chamber comprising a cylindrically-shaped ammunition-holding cavity formed therethrough. The ammunition-holding cavity being collinear with the bore axis and having a diameter sized to receive a cylindrically-shaped round of ammunition. The chamber is adapted for linear movement between a charged position and a firing position, wherein the linear chamber movement is relative to the barrel and collinear with the bore axis. In the chamber charged position, the chamber is positioned rearward of and away from the barrel, the bolt is also in its charged position and a forward surface of the bolt is generally coplanar with a forward surface of the chamber, with the bolt occupying the ammunition-holding cavity. In the chamber firing position, a forward surface of the chamber sealingly contacts a rearward surface of the barrel, the bolt is also in its firing position and a forward end of the bolt sealingly contacts a rearward end of the chamber, with the chamber ammunition-holding cavity largely vacated by the bolt.

A method associated with this further embodiment comprises placing the chamber and bolt in their respective charged positions, then begins to move the chamber and bolt to their respective firing positions. Introducing a round of cased telescoped or case-less ammunition between the forward surfaces of the chamber and bolt and the rearward surface of the barrel, before the chamber and bolt reach their firing positions. Restraining movement of the round of ammunition along the bore axis, and relative to the barrel, by trapping the round between the forward surfaces of the chamber and bolt and the rearward surface of the barrel. Moving the round of ammunition to be collinear with the bore axis, then moving the chamber toward the barrel to over-ride the round of ammunition. Sealing the chamber against the barrel, and releasing the firing pin to fire the round of ammunition.

In another embodiment of the present invention, an ammunition feed system is provided. The system comprises an ammunition container having a path for holding a plurality of cased telescoped or case-less ammunition rounds in a single file manner, and an exit for passing the ammunition rounds out of the container. A cylindrical pusher is positioned in and adapted to freely slide through the ammunition path, with the plurality of ammunition rounds being positioned between the exit and the cylindrical pusher. The cylindrical pusher is also adapted to push the ammunition toward the exit. A feed line is connected to the cylindrical pusher and being of a length to extend through the ammunition path and out of the exit, and having a width to be able to be in the ammunition path without disturbing the movement of the plurality of ammunition. A feed line spool is provided, capable of rotating, and positioned adjacent to the exit and adapted to collect the feed line while rotating. A feed sprocket is also provided, capable of rotating, and attached to and collinear with the feed line spool. The feed sprocket is adapted to turn in unison with the feed line spool and comprises radially spaced teeth. When the feed sprocket rotates, the teeth grip and move the ammunition from the container exit to a firearm associated with the ammunition feed system.

A further embodiment of the present invention provides a method of feeding ammunition into a firearm. The method comprises providing a plurality of ammunition rounds in a path, with the path having an exit and a distal end. Pulling a cable through the path containing the plurality of ammunition rounds. Pulling a pusher through the path from the distal end toward the exit by attaching it to the cable, with the pusher being adapted to slide through the path and push the plurality of ammunition rounds toward the exit. When a round of ammunition reaches the exit, presenting the round of ammunition to the firearm.

BRIEF DESCRIPTION OF THE FIGURES

The accompanying drawings, which are incorporated in and constitute a part of this specification, illustrate embodiments of the invention and, together with the description, serve to explain the principles of the invention.

DESCRIPTION OF THE PREFERRED EMBODIMENTS

The following description is intended to convey a thorough understanding of the invention by providing a number of specific embodiments and details involving an automatic weapon. It is understood, however, that the invention is not limited to these specific embodiments and details, which are exemplary only. It is further understood that one possessing ordinary skill in the art, in light of known systems and methods, would appreciate the use of the invention for its intended purposes and benefits in any number of alternative embodiments. Throughout the specification, the use of the terms "front" or "forward" refer to the muzzle end of the firearm or toward the muzzle, and the terms "rear" or "rearward" refer to the buttstock end of the firearm or toward the buttstock.

Figure 1:
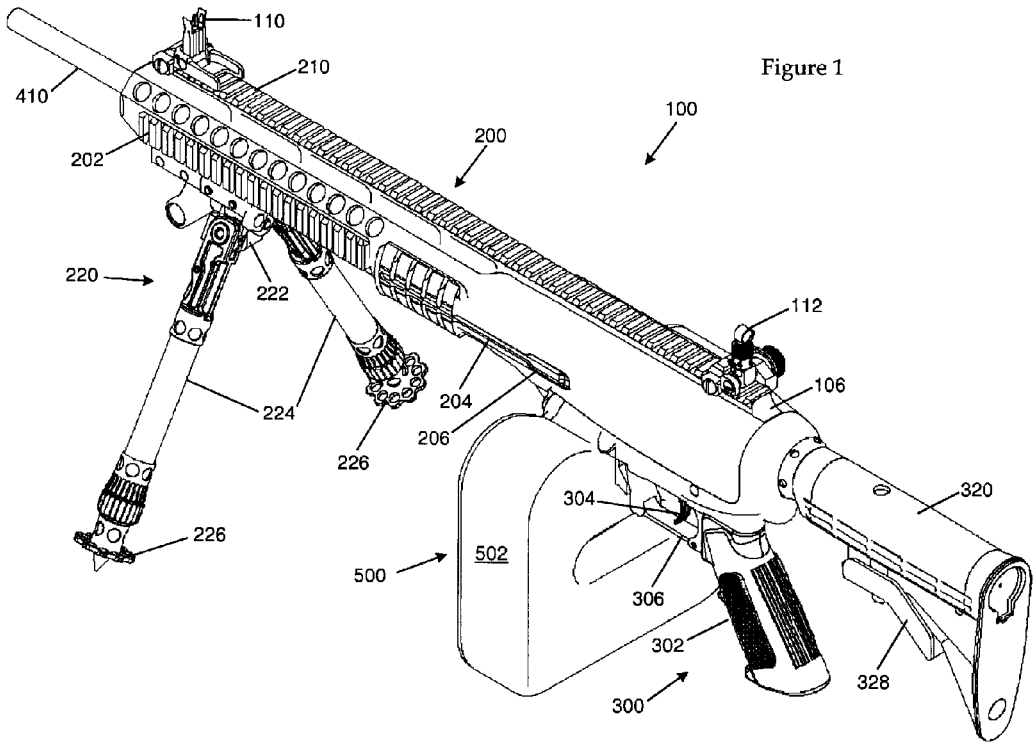
FIG. 1 is a perspective view of an embodiment of the present invention.
Figure 2:
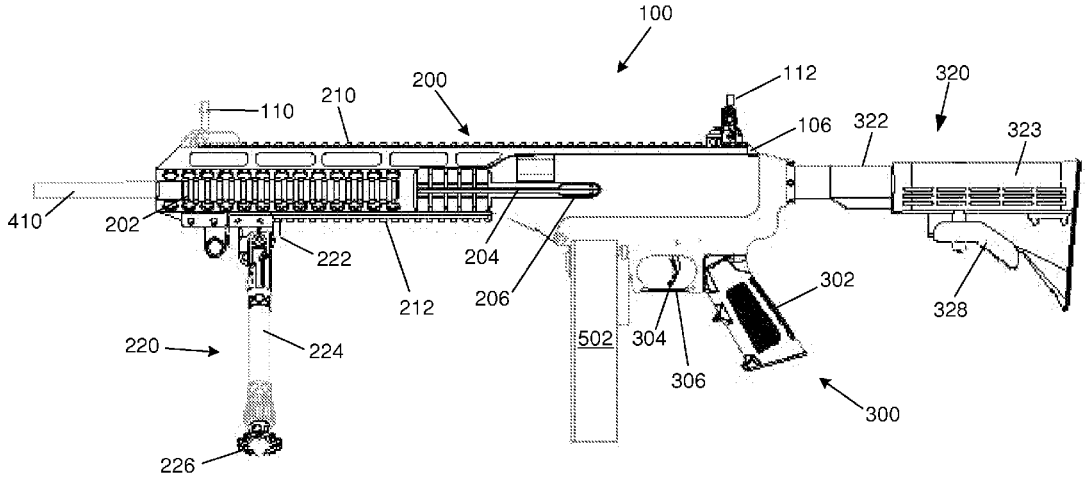
FIG. 2 shows a side view of the embodiment shown in FIG. 1.
Figure 3:
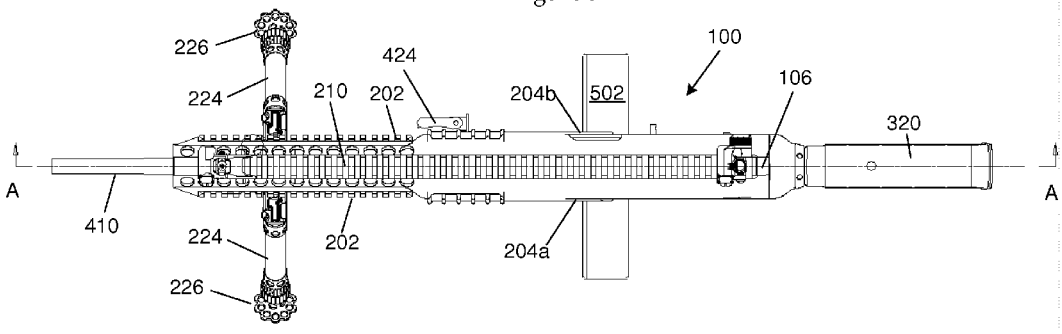
FIG. 3 shows a top view of the embodiment shown in FIG. 1.
Figure 4:
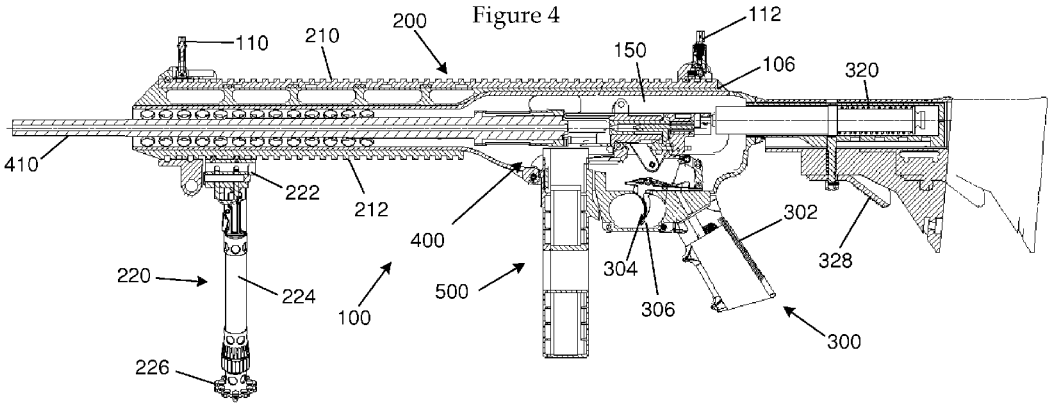
FIG. 4 is a cross-sectional side view of the embodiment of FIG. 1, shown along line A-A of FIG. 3.
Figure 9:
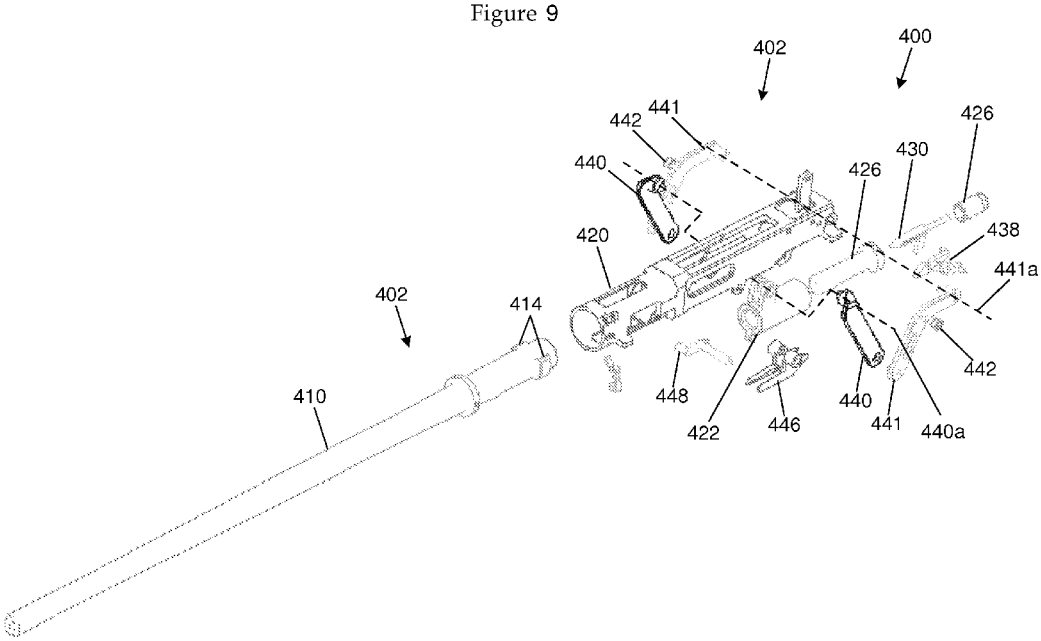
FIG. 9 is an exploded view of the internal operating group.
Figure 10A:
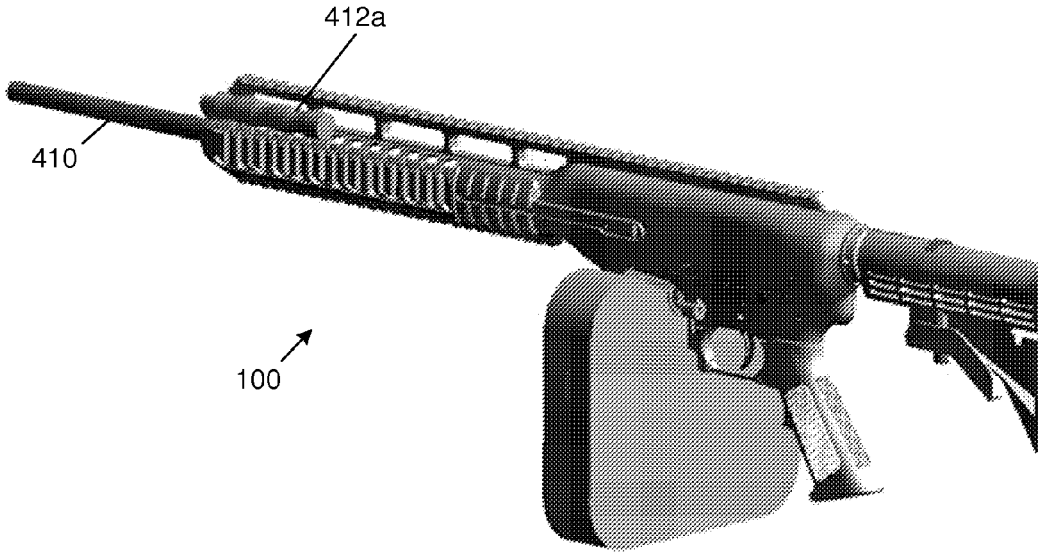
FIG. 10A is a perspective view of the present invention with the barrel handle in the stowed position.
Figure 10B:
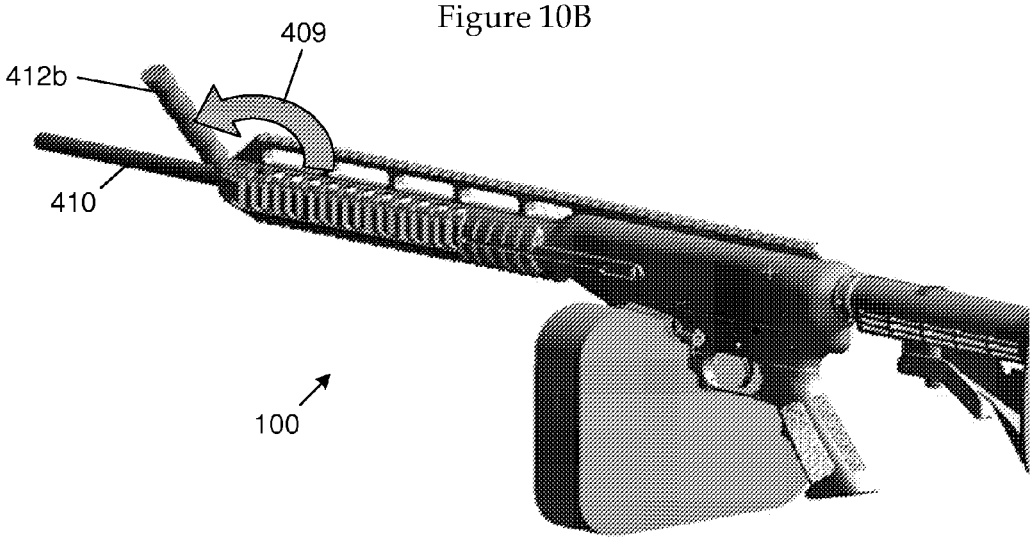
FIG. 10B is a perspective view of the present invention with the barrel handle in the extended position.
Figure 10C:
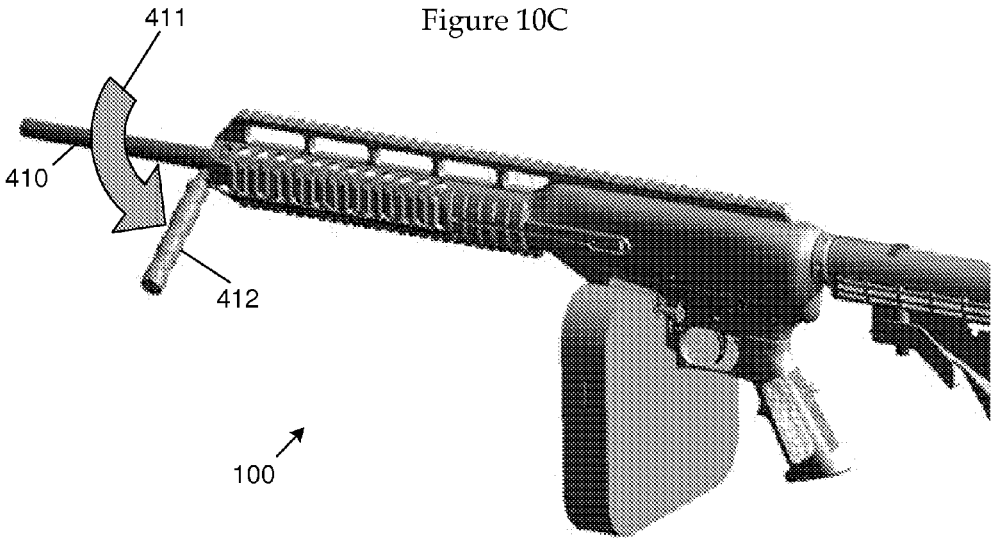
FIG. 10C is a perspective view of the present invention with the barrel handle extended and rotated.
Figure 10D:
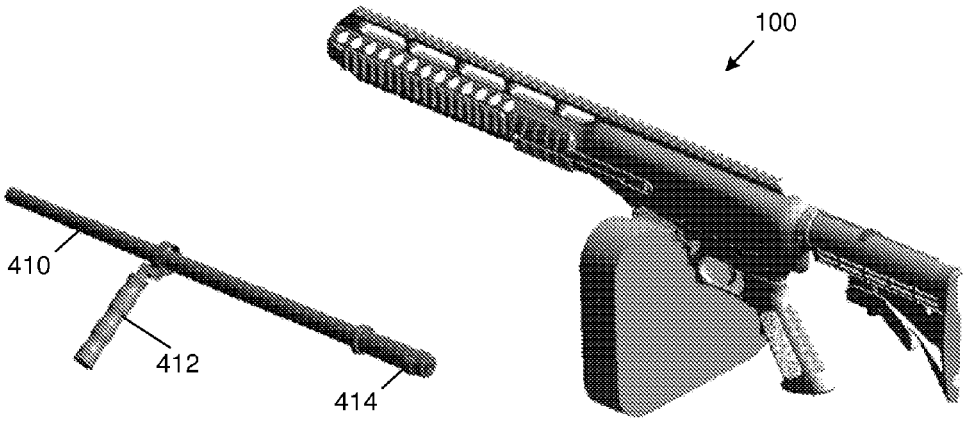
FIG. 10D is a perspective view of the present invention with the barrel removed from the receiver.
Figure 11:
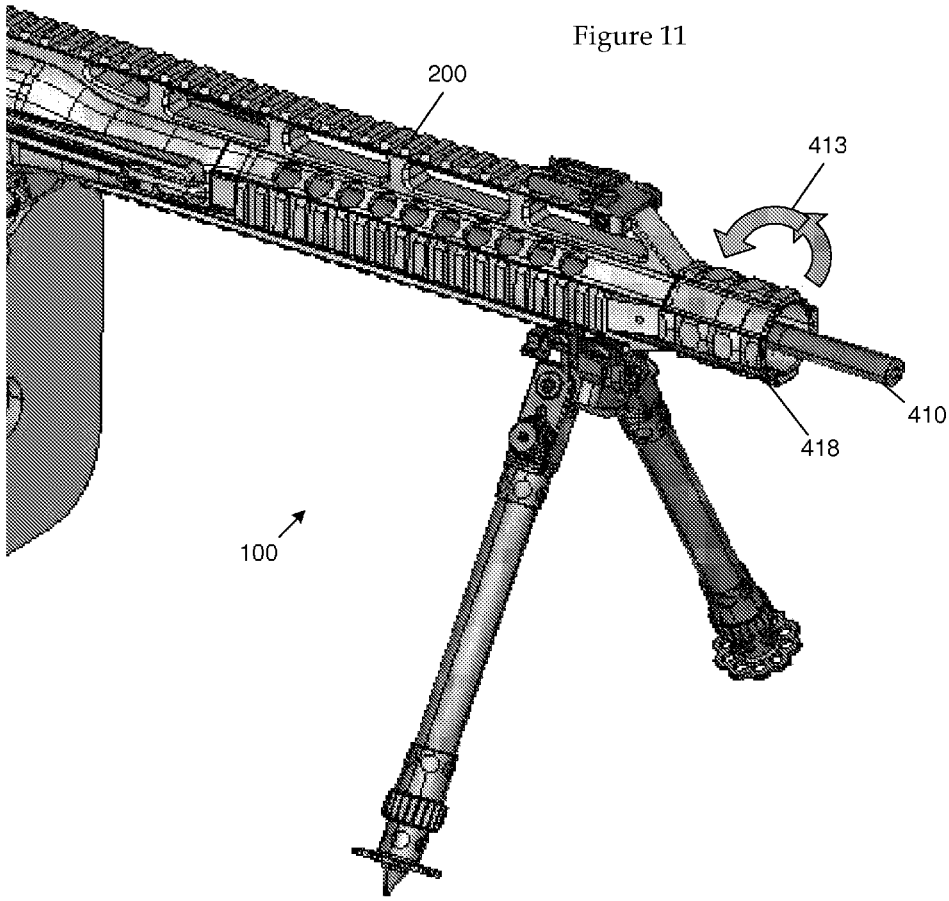
FIG. 11 is perspective view of another embodiment of the present invention, showing the barrel with a collar instead of a handle.

Referring to FIG. 1, a lightweight, air-cooled, recoil operated machine gun is provided as an exemplary embodiment of the invention. The weapon 100 of the preferred embodiment comprises an upper receiver 200, a lower receiver 300, an operating group 400 (shown in FIG. 9), and a linkless-ammunition feed system 500.

Referring now to FIGS. 1-5C, the weapon 100 comprises an upper receiver 200 and a lower receiver 300. The upper receiver 200 and lower receiver 300 cooperate to at least partially house the internal operating group 400 within a cavity 150. The upper receiver 200 comprises an external gripping surface 202 for the operator, left 204*a* and right 204*b* charger ports, an eject gate 208, and upper 210 and lower 212 rails.

Charger ports 204 comprise charger covers 106. Left and right charger ports 204*a*, 204*b* allow the charger handle 424 to be positioned for ambidextrous use of the weapon 100. Charger covers 206 provide a barrier limiting the dirt or other contaminants that may otherwise enter the weapon and jam or limit the operation of the internal operating unit 400.

Figure 5A:
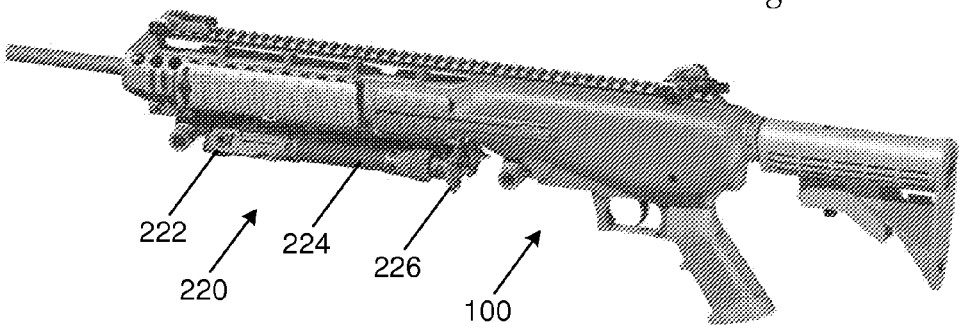
FIG. 5A is a perspective view of the weapon of the present invention with the bipod in the stowed position.
Figure 5B:
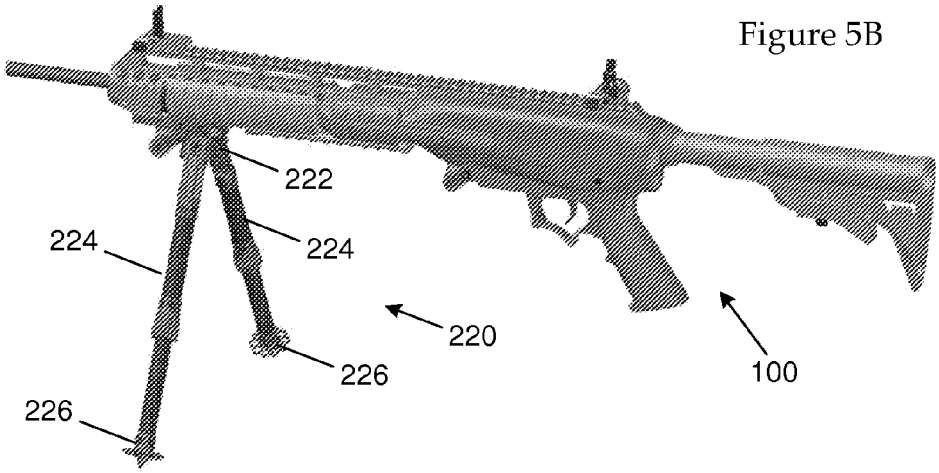
FIG. 5B is a perspective view of the weapon of the present invention with the bipod legs and feet extended
Figure 5C:
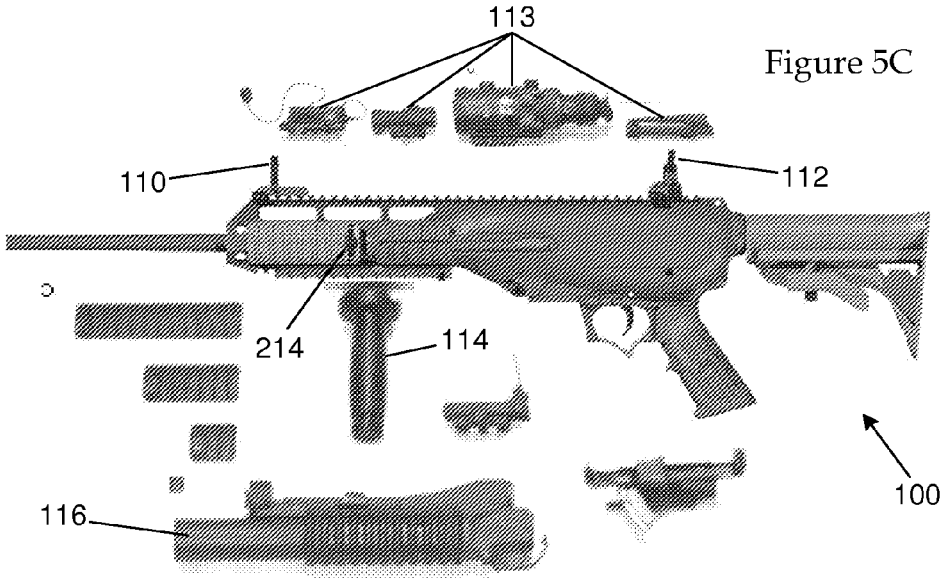
FIG. 5C is a side view of the weapon of the present invention, shown with a variety of optional accessories.

Referring to FIGS. 5A-C, the upper receiver comprises an upper rail 210 and a lower rail 212. The rails 210, 212 are adapted to provide versatile attachment points for a variety of accessories. Such attachable accessories may include, for example, a forward iron sight 110, a rearward iron sight 112, other scopes and sighting and/or aiming systems 113, a tripod or bipod 220, bipod mounts 222, a pintle 118 for mounting to a tripod, grenade launchers 116, handles 214, and slings or sling mounts. Upper receiver 200 may also include other means for attaching accessories such as a mount 214 for attaching a handle 114 or other means for mounting the weapon to any appropriate support.

In an embodiment of the invention, a bipod 220 is removably mounted to the lower rail 212. Bipod mount 222 allows bipod 220 to be alternatively moved between a stowed or extended position. In the stowed position, bipod 220 is positioned against a lower portion of the upper receiver 200. In the extended position, bipod 220 is moved so that the bipod legs 224 are essentially perpendicular to the upper receiver 200. Bipod legs 224 are extendable and comprise feet 226, appropriate for stabilizing the forward section of the weapon on a variety of surfaces. Other variations comprise removable and interchangeable feet, allowing the operator to select feet most appropriate for the environment in which the weapon 100 will be deployed. Alternatively, bipod 220 could be permanently mounted to lower rail 212 or another portion of the upper or lower receiver. Such Bipod assemblies are generally known in the art. Other bipod assemblies may be used.

Figure 7:
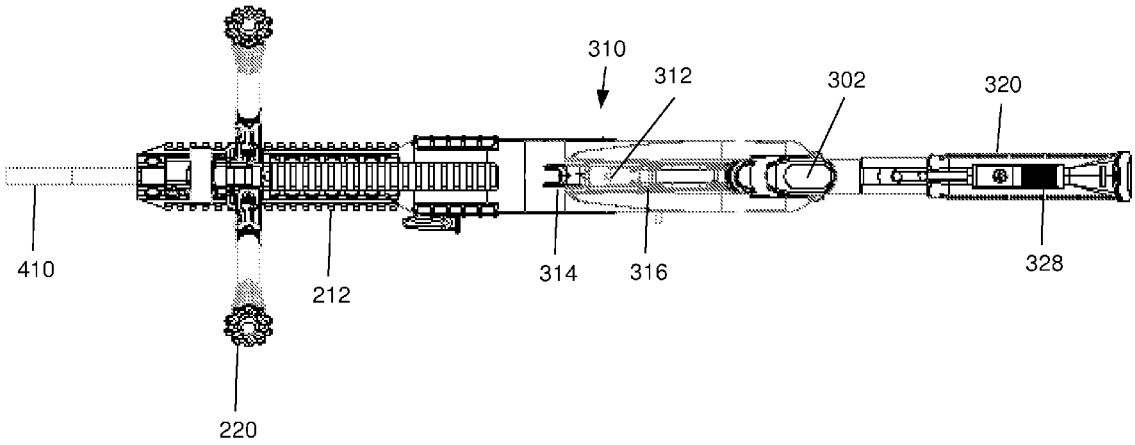
FIG. 7 is a bottom view of the embodiment shown in FIG. 1.
Figure 8:
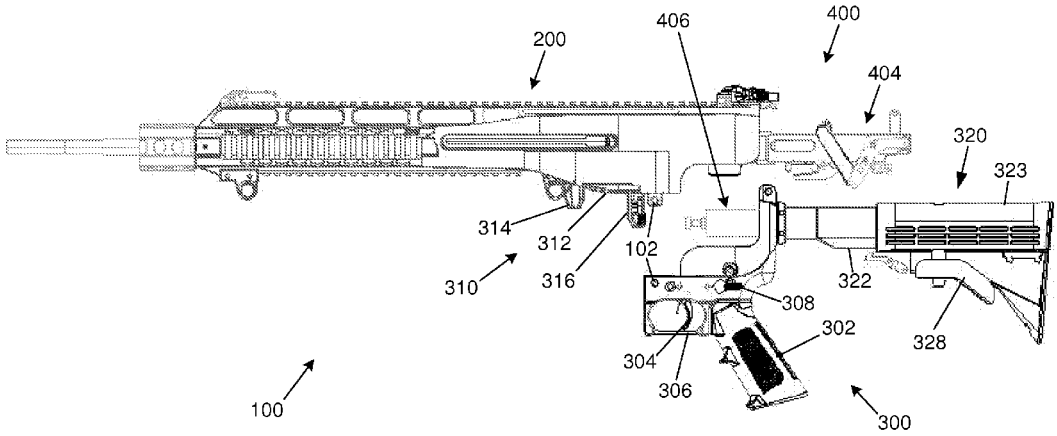
FIG. 8 is a partially exploded side view of the present invention.

Referring now to FIGS. 7-8, the upper receiver 200 and lower receiver 300 are hingedly connected at hinge 102 forward of trigger 304. The hinge 102 may comprise any appropriate hinge assembly as would be apparent to one of skill in the art. The two receivers 200, 300 latch together, forming an internal weapon cavity 150, which houses the internal operating group 400.

When the two receivers 200, 300 are unlatched, they pivot about hinge 102, opening the weapon to allow the operator access to the cavity 150 and internal operating group 400. The internal operating group comprises a barrel assembly 402, a firing assembly 404, and a recoil assembly 406. Once the two receivers 200, 300 are unlatched and opened, the recoil assembly 406 may be removed from the firing assembly 404, and the firing assembly 404 and the barrel assembly 402 may then be pulled from the firearm upper receiver 200 for maintenance and/or repair.

The lower receiver 300 houses the recoil assembly 406 and includes various control features and an ammunition well 310. The control features comprise a pistol grip 302, a trigger 304, a trigger guard 306 and a safing lever 308. The safing lever may be operable to place the weapon in safe, semi-automatic, automatic, or other firing modes. Such safing levers 308 and mechanisms are generally known in the art.

An ammunition container 502 attaches to the ammunition well 310, which comprises front 314 and rear 316 container guides. Left and right release levers (not shown) allow for removal of container 502 and can be actuated from either side or from both sides of the weapon.

Figure 6:
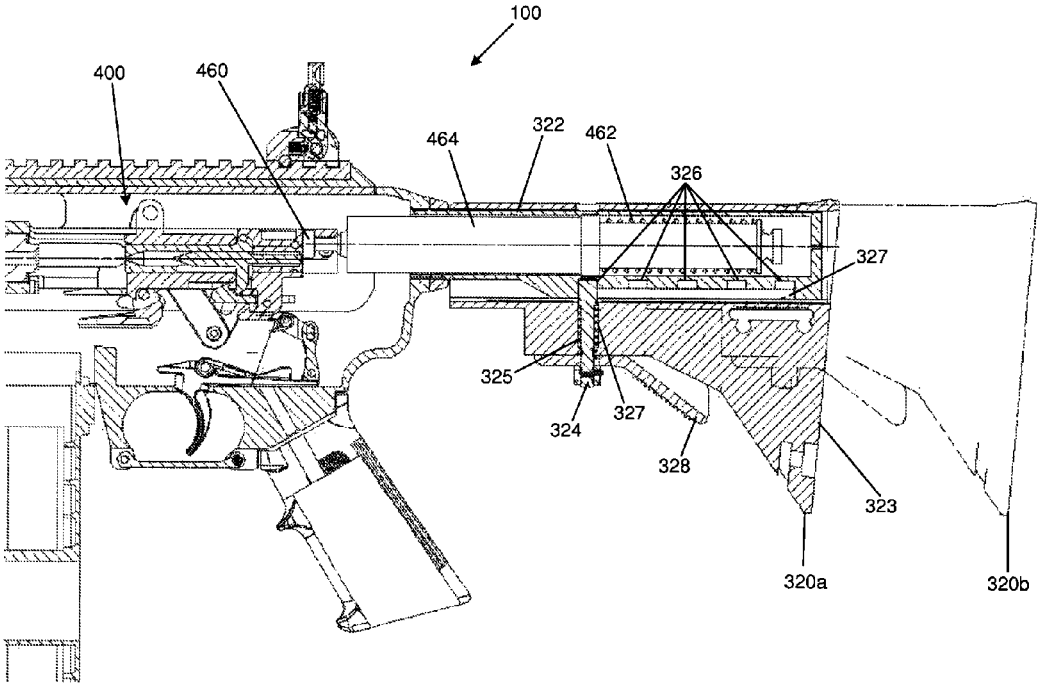
FIG. 6 is a side cross-sectional view of the lower receiver of the present invention, shown along line A-A of FIG. 3.

As illustrated in FIG. 6, embodiments of the lower receiver comprise a buttstock 320 at the rear end of the weapon 100. The buttstock 320 is movable between a collapsed position 320*a* and an extended position 320*b*. The buttstock comprises a fixed portion 322 and a movable portion 323. The movable portion 323 telescopes with respect to the fixed portion 322. A pin 324 passes through a groove 327 in the movable portion 323 and engages one of a series of recesses 326 in the fixed portion 322. The pin 324 is biased into the recesses 326 by a spring 325 and serves to lock the fixed 322 and moving 323 portions of the buttstock 320 at varying degrees of extension. A lever 328 is positioned on the under side of buttstock 320 and the lever 328 moves pin 324 between a locked position in which pin 324 engages one of recesses 326 and a disengaged position in which pin 324 disengages from recesses 326. Such Buttstock assemblies are generally known in the art, and other Buttstock assemblies may be used.

The upper receiver 200 and lower receiver 300 of the preferred embodiment are manufactured from a carbon/epoxy composite. However, the receivers 200, 300 could alternatively be manufactured from any suitable material known in the art.

Referring now to FIGS. 9-11D, the barrel assembly 402 comprises a barrel 410, a barrel handle 412, and lugs 414. The barrel 410 is preferably manufactured from Cr—Mo steel with a chromium plated bore. However, the barrel 410 could be manufactured of other materials known in the art. In addition, the barrel 410 preferably has a twist ratio of 1 turn per 9 inches of barrel length.

The barrel assembly 402 further comprises a quick-change feature allowing for quick barrel replacement. The preferred embodiment provides for the entire barrel assembly 402 to be quickly and simply removed from and a new assembly re-attached to the weapon 100 in about 10 seconds. The lugs 414 are located at the breech end of the barrel 410, while the barrel handle 412 is preferably located near the muzzle of the barrel 410. It should be noted that the handle may be located anywhere along the length of the barrel 410. When the barrel assembly 402 is attached to the weapon 100, the barrel is received in the barrel extender 420, the lugs 414 are mechanically engaged with the barrel extension 420, and the handle 412 is in its stowed position—generally parallel to the barrel 410.

As illustrated in FIGS. 11A-11D, to remove the barrel 410, the operator first extends the handle 412 from its stowed position 412*a* to its extended position 412*b*, approximately perpendicular to the barrel 410, as illustrated by arrow 409. The operator then rotates the barrel 410 and handle 412 approximately 90° about the longitudinal axis of the barrel 410, as illustrated by arrow 411. Rotating the barrel 410 disengages the lugs 414 from the barrel extender 420, allowing the whole barrel assembly 402 to be detached from the firing assembly 404 and removed from the upper receiver 200. Barrel replacement takes place in the reverse sequence.

During weapon firing, the handle 412 is not in contact with the barrel 410 keeping the handle 412 cool for ease of handling during barrel removal. For operator safety, the barrel may not be removed while the weapon is charged, nor may the weapon be charged unless a barrel is attached.

Referring to FIG. 12, a variation of the preferred embodiment comprises a concentric collar 418 instead of a handle 412. The collar 418 is located at the forward end of the upper receiver 200 engages and unlocks the barrel 410. Turning the collar 418 through a predetermined angle, illustrated by arrow 413, unlocks the barrel 410 from the barrel extender 420. Turning the collar 418 through a further angle enables removal of the barrel 410 and collar 418 from the weapon 100. Again, barrel 410 replacement takes place in reverse sequence.

The structure the firing mechanism will now be explained. Referring to FIGS. 9, and 12A-15F, some of the major components of the firing assembly include a barrel extension 420, a chamber 422 having an ammunition holding cavity, a charging handle 424, a bolt 426, a firing pin 430, a firing pin spring 436, a two-position firing pin latch 438, forward and rear chamber toggles 440, 441, a toggle rail 444, a load pawl 446, a fixed and a movable load pawl cams 450, 452, a sear 454, a sear link 456, and a sear spring 458.

The inner surface of the upper receiver 200 comprises cam ways that interact with the internal operating group 400. The left 444*a* and right 444*b* toggle cam ways provides a path for the toggle cam rollers 442 to follow, a fixed load pawl cam way 450 provides an ammunition loading path for the load pawl pivot arm 448 to follow, and a movable load pawl cam way 452 provides an ejection path for the load pawl pivot arm 448 to follow. The load pawl pivot arm 448 follows the fixed load pawl cam 452 throughout its forward motion as it loads ammunition 120 into the chamber, and follows the movable cam 452 as it moves rearward and ejects a spent shell. The movable load pawl cam way 452 is thus movable between two positions, a by-pass position and an eject position and is biased to the eject position by a spring (not shown). In the by-pass position, the movable cam 452 is pivoted upward due to the forward movement of the load pawl pivot arm 448. In the eject position, the movable cam 452 is lined up with the fixed cam 450, and provides a path for the load pawl pivot arm 448 to follow when it ejects a spent shell. The interaction between the rollers and cam ways are discussed in greater detail herein.

The forward 440 and rear 441 chamber toggles are hingedly connected to each other. The rear chamber toggle 441 is also hingedly connected to the barrel extension 420, and the forward chamber toggle 440 is hingedly connected to the chamber 422. The rear chamber toggle 441 comprises a roller 442, which rides in a toggle rail or cam 444. The toggle rail 444 is attached to the upper receiver's internal surface 201, and fixed relative to the other components of the firing assembly 404. In addition, it is contemplated that the toggle rail 444 may be integrally formed with or permanently or removably attached to the interior surface 201. As the firing assembly 404 moves through the firing cycle, the fixed toggle rail 444 controls the position of the toggles 440, 441, which, in turn, controls the position of the chamber 422 relative to the barrel extension 420. The load pawl 446 is also hingedly connected to the barrel extension 420 and comprises a roller. The load pawl pivot arm 448 rides in both a fixed load pawl rail 450 and a movable load pawl rail 452. The load pawl cams 450, 452 are attached to the upper receiver interior surface 201. The fixed load pawl cam 450 may be integrally formed with or permanently or removable attached to the interior surface 201. The chamber 422, bolt 426, firing pin 430 are concentric with each other and are all collinear with the barrel 420. In addition, the bolt 426 is fixed relative to the barrel 410, eliminating the need for any complex locking mechanism.

Figure 12A:
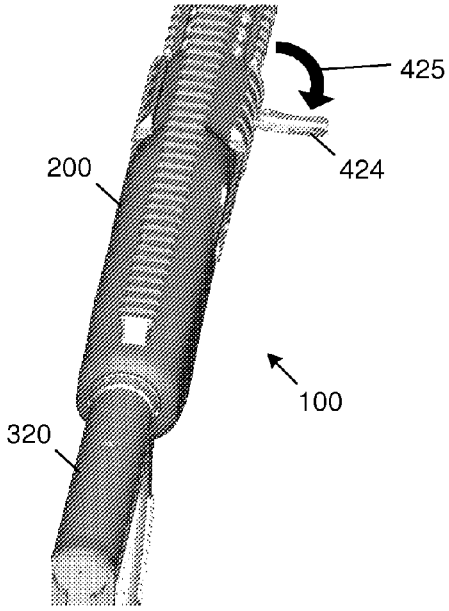
FIG. 12A is a top perspective view showing the charging handle extended.
Figure 12B:
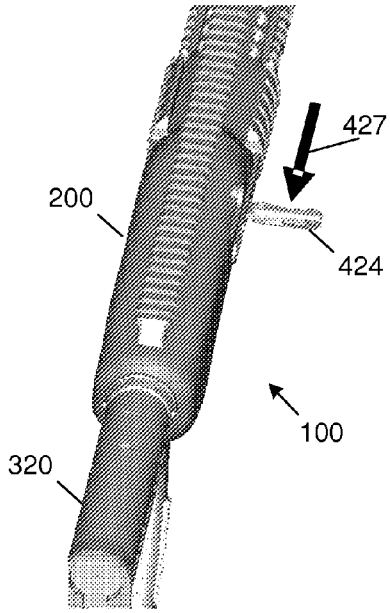
FIG. 12B is a top perspective view showing the charging handle extended and charged.

The operating cycle of the weapon begins with charging the weapon. Referring specifically to FIGS. 12A-12B, charging the weapon 100 for firing, first requires the operator to extend the charging handle 424 from a stowed position to a ready position (arrow 425, FIG. 12A). The charging handle 424 is then pulled rearward, toward the buttstock 320 (arrow 427, FIG. 12B). Referring to FIGS. 15A-16A, as the charging handle 424 is moved rearward, the eject port is opened (not shown), the recoil spring 462 is compressed, and the entire firing assembly 404 is moved to the sear position and latched in place by the sear 454 (see FIG. 15A). In the sear position, the toggles 440, 441 are folded, holding back the chamber 422, which creates a clearance between the barrel 410 and the chamber 422. This clearance provides an opening for the next round of ammunition 120, which will eventually move upward from the magazine 200 to be parallel and linear with the barrel 410 and chamber 422.

Figure 13A:
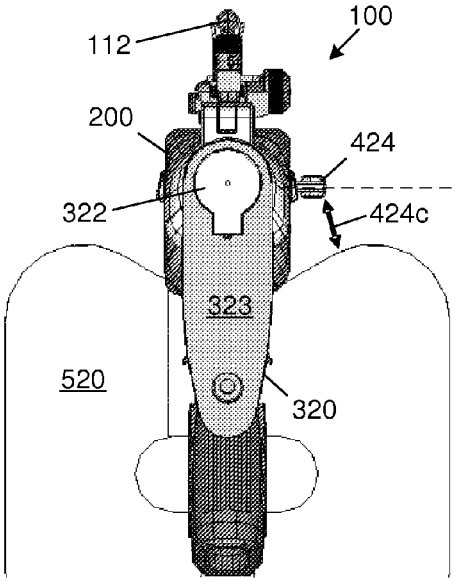
FIG. 13A is an end view showing the charging handle arranged horizontally.
Figure 13B:
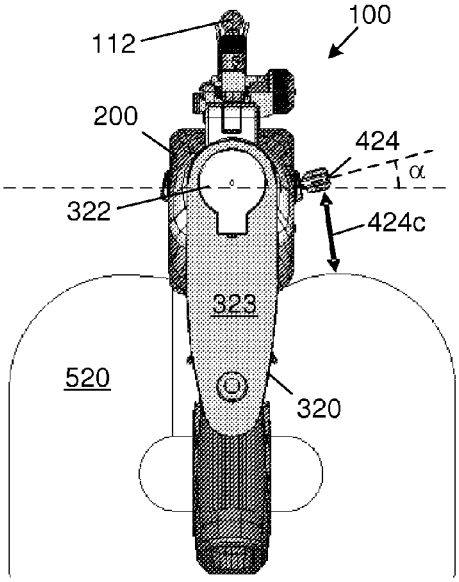
FIG. 13B is a top view showing the charging handle offset from horizontal.
Figure 14A:
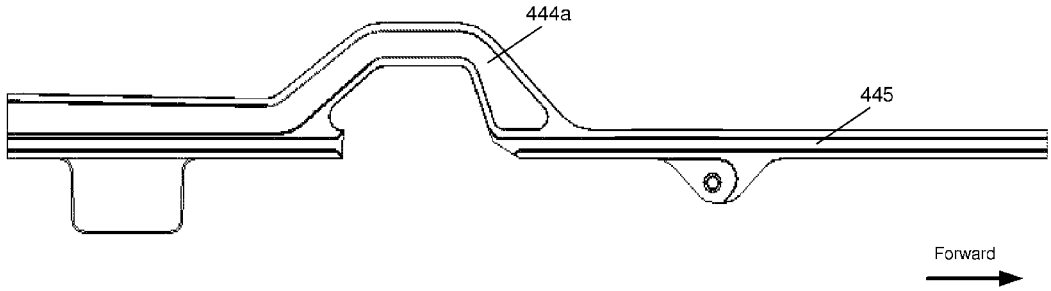
FIG. 14A is a side view of the left side cam way.
Figure 14B:
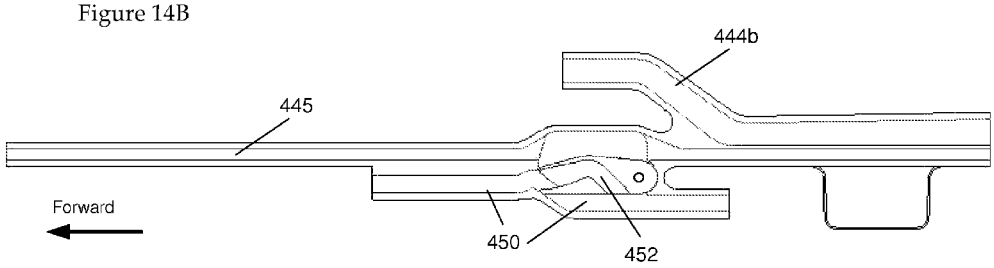
FIG. 14B is a side view of the right side cam way.

As shown in FIGS. 13A-13B, the charging handle 424 can be alternatively positioned on either the right or left side of the weapon for ambidextrous use. In a preferred embodiment, the charging handle 424 is positioned at an angle a approximately fifteen degrees above horizontal. This provides additional clearance 424*c* between the handle 424 and ammunition container 200 (FIG. 13B). Alternatively, the charger handle 424 may extend horizontally from the weapon (FIG. 13A).

With the weapon 100 charged, it is now ready to fire. The weapon firing cycle may be best understood in relation to FIGS. 14A-15F.

Figure 15A:
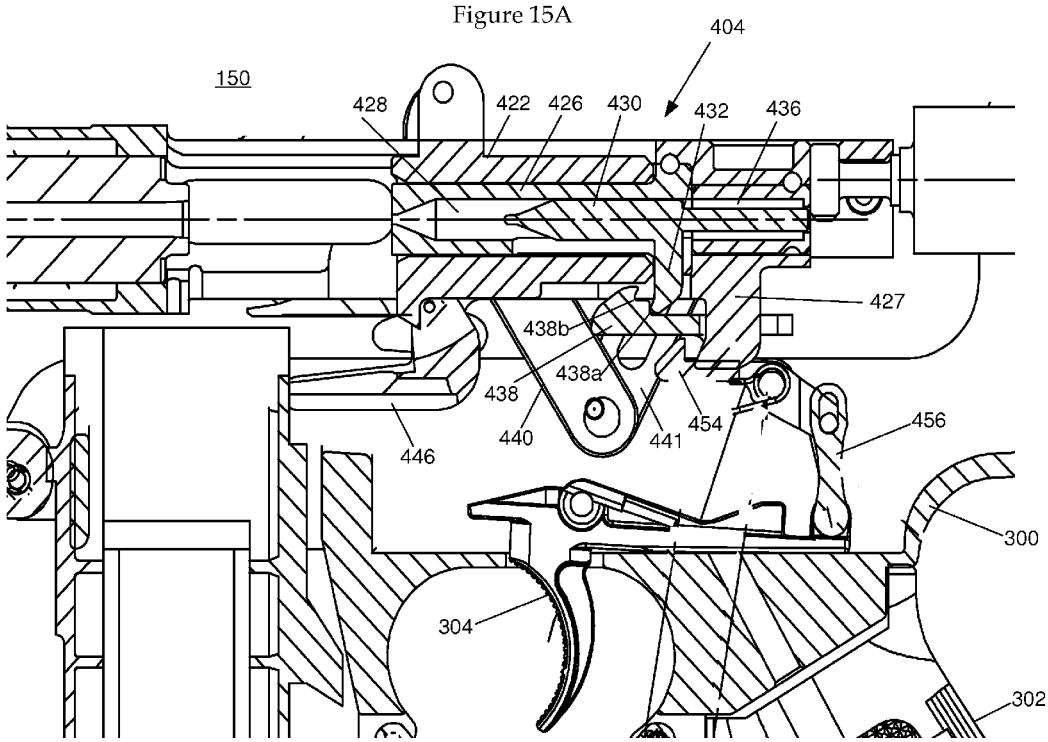
FIG. 15A is a detail of FIG. 4, showing the firing assembly in the sear position.

In FIG. 15A, the firing assembly 404 is in the sear position and the weapon is ready to fire. In the sear position, the firing assembly 404 is held back by the sear 454 and the firing pin 430 is held in a first sear position by the two-position firing pin latch 438. The toggles 440, 441 are held in a bent configuration by the toggle rail 444 (see FIG. 15B), thus holding back the chamber 422. The chamber 422 butts against a bolt lug 427 and a firing pin lug 432 and is completely occupied by the bolt 426. To fire the weapon 100, the operator releases the firing assembly 404 from the sear position by pulling the trigger 304. This movement pivots the trigger 304, pushing the sear link 456 upward, which then pivots the sear 454 to release the firing assembly 404. Now released, the firing assembly 404 begins to move forward under force of the recoil spring 462. This forward movement pushes the load pawl 446 under the next ammunition round 120 and begins to push the barrel 410 forward with respect to the upper receiver 200. The slides relative to the upper receiver in barrel extension tracks 445.

Figure 15B:
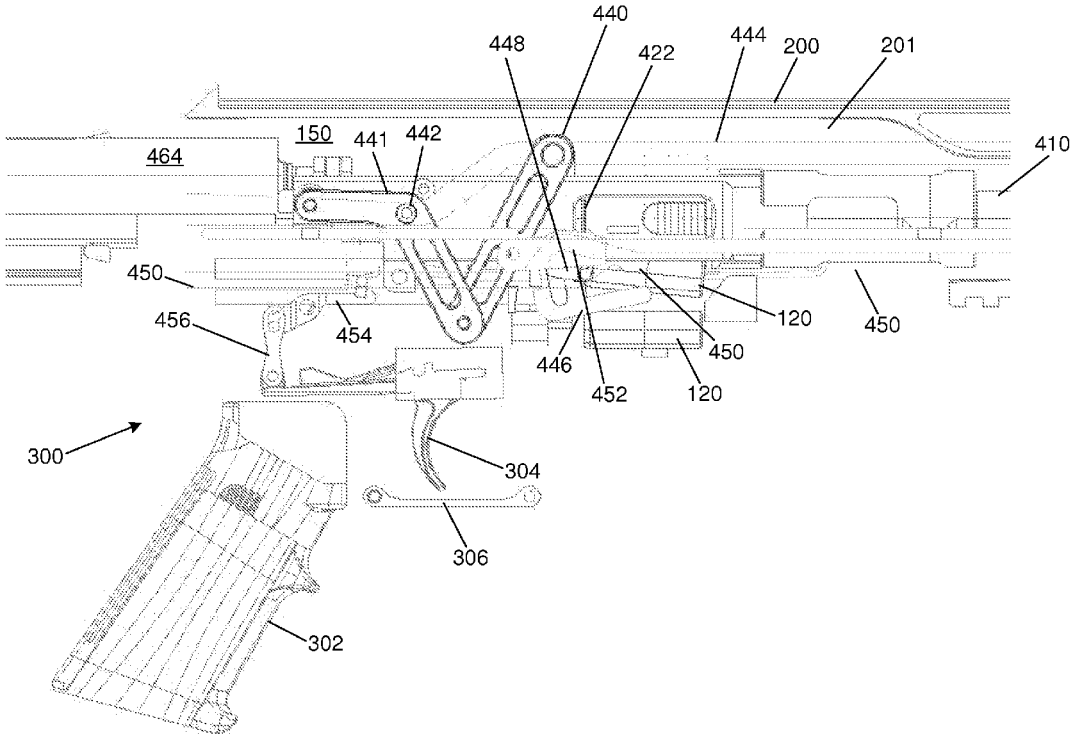
FIG. 15B is a cut-away side view of firing assembly at a second point of the firing cycle.

Referring to FIG. 15B, the firing assembly 404 continues forward, pushing the load pawl pivot arm 448 along the fixed load pawl rail 450, which causes the load pawl 446 to pivot upward. As the load pawl pivot arm 448 follows the fixed load pawl rail 450, it pushes on the bottom of the movable pawl rail 452 to pivot it upward to its by-pass position and out of the path of the forward moving load pawl pivot arm 448. Once the load pawl pivot arm 448 clears the moving rail 452, the moving rail 452 drops back down to its eject position. This movement begins to lift the round 120 from the top of the ammunition magazine 200. Once the round 120 is out of the container, the firing assembly has progressed far enough for the firing pin latch 438 to engage in a firing pin cam (not shown). The cam pivots the firing pin latch 438 from a first position to a second position, releasing the firing pin 430. The firing pin 430 is now able to proceed under the force of the firing pin spring 436. However at this point, the firing pin 430 is still prevented from proceeding forward by contact between the firing pin lug 432 and the chamber 422.

The chamber 422 is preloaded forward by the firing pin spring 436. Accordingly, as the load pawl 446 lifts the round 120 upward, the forwardly biased chamber 422 traps the round 120 between the vertical surfaces of the chamber and the barrel. This orients the round 120 parallel with the chamber and barrel while the load pawl continues to push the round upward until the round is co-linear with the chamber and barrel.

Figure 15C:
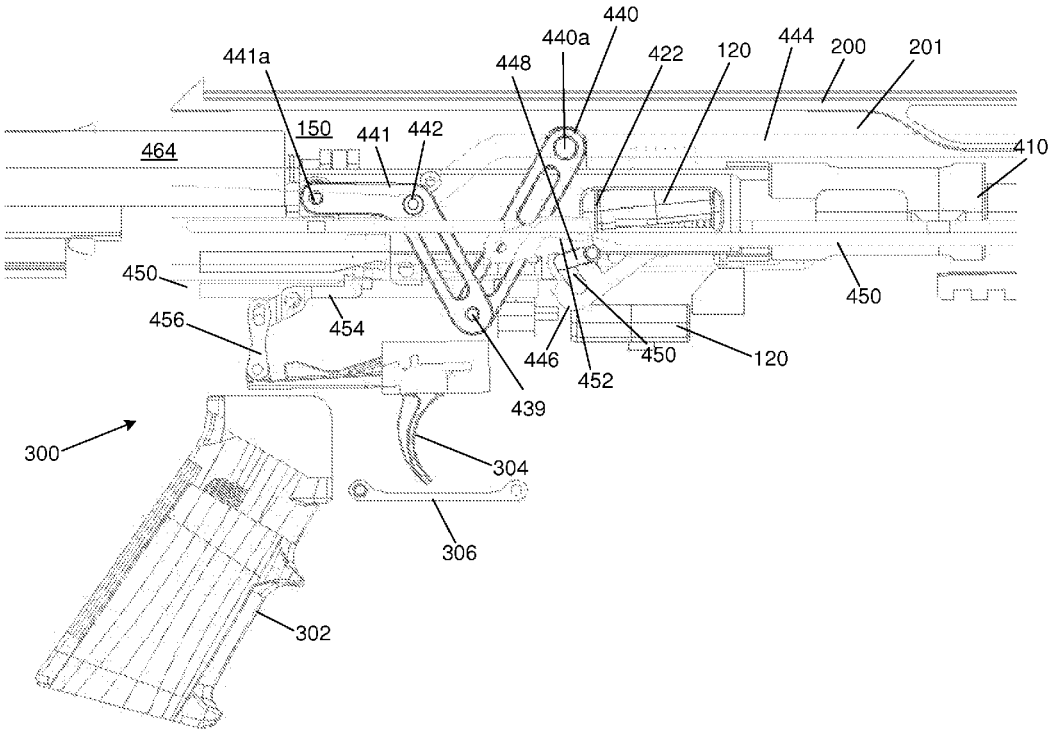
FIG. 15C is a cut-away side view of firing assembly at a third point of the firing cycle.

Referring now to FIG. 15C, the firing assembly 404 continues forward and the load pawl 446 continues to pivot upward, placing the round 120 collinear with the chamber 422 and barrel 410. Also at this time, the toggle rollers 442 are guided by the toggle rail 444, rotating the rear toggles 441 about axis 441*a*, which then causes the forward toggles 440 to rotate about axis 440*a*. This motion straightens the toggles 440, 441 at the connecting joint 439 and pushes the chamber 422 forward. The forward moving chamber 422 simultaneously takes up the clearance between itself and the barrel 410 and pushes past the bolt 426, overriding the round 120. In this manner, the chamber 422 is continuously occupied by either the bolt 426 or an ammunition round 120, and foreign debris is prevented from entering the chamber 422.

At the same time, this movement also creates clearance between the chamber 422 and the firing pin lug 432, allowing the firing pin spring 436 to push the firing pin 430 forward. As the firing pin 430 moves forward, the firing pin lug 432 engages the firing pin latch 438 at the second sear position 438*b*. The firing pin cam (not shown) interlocks with the pin latch 438 to prevent release of the firing pin 430 until the chamber 422 is closed. As the chamber 422 closes, it overrides the round 120 while the load pawl 446 drops slightly to clear the chamber 422.

Figure 15D:
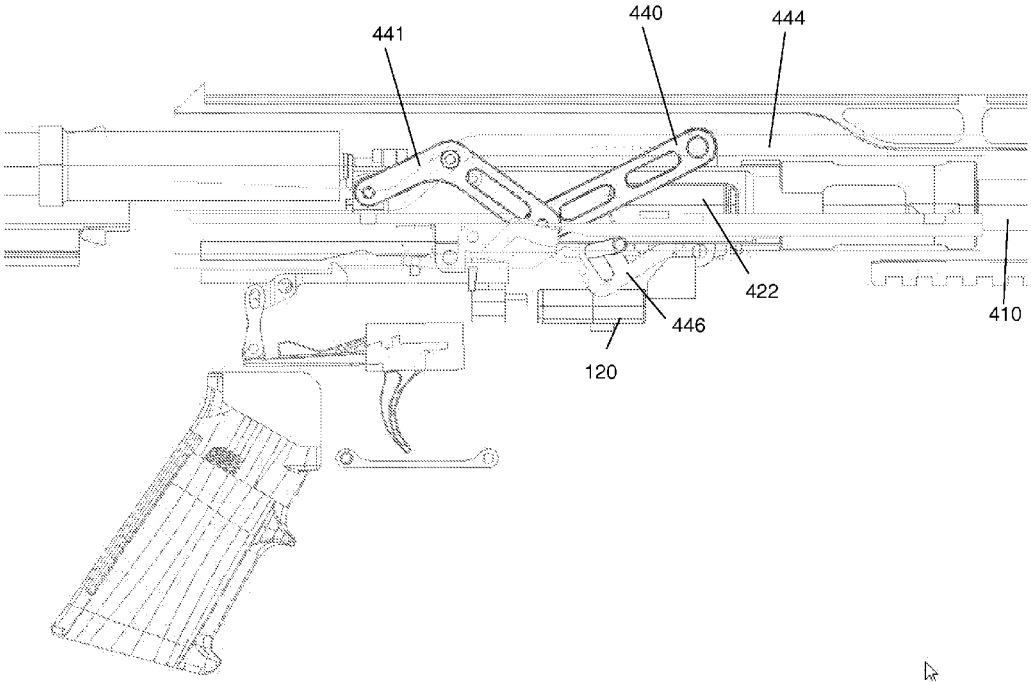
FIG. 15D is a cut-away side view of firing assembly at a fourth point of the firing cycle.
Figure 15E:
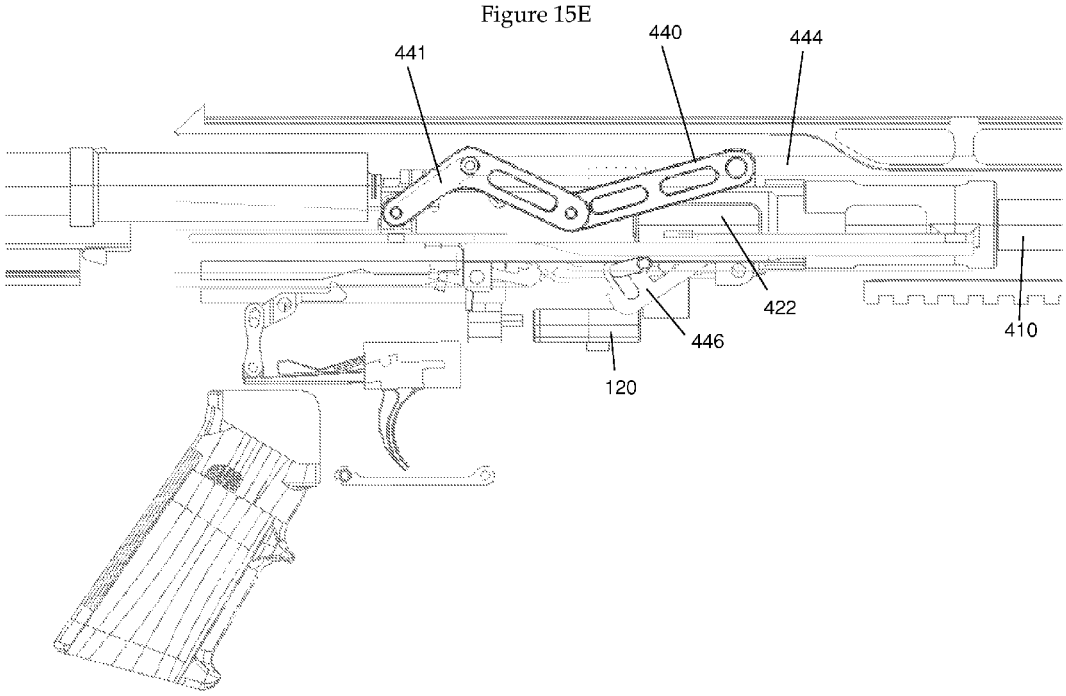
FIG. 15E is a cut-away side view of firing assembly at a fifth point of the firing cycle.

In FIGS. 15D and 15E, the chamber 422 has closed and the assembly 404 continues forward. The firing pin cam further pivots the firing pin latch 438, releasing the firing pin 430 from the second sear position 438*b*. The firing pin 430 moves through the bolt slot 428 and impacts the cartridge primer 128 (see Figure A), which ignites the cartridge propellant 130 creating a high-pressure gas to send the bullet 122 down and out of the barrel 410. The recoil force generated by the discharge of the round 120 pushes the firing assembly 404 rearward.

Figure 15F:
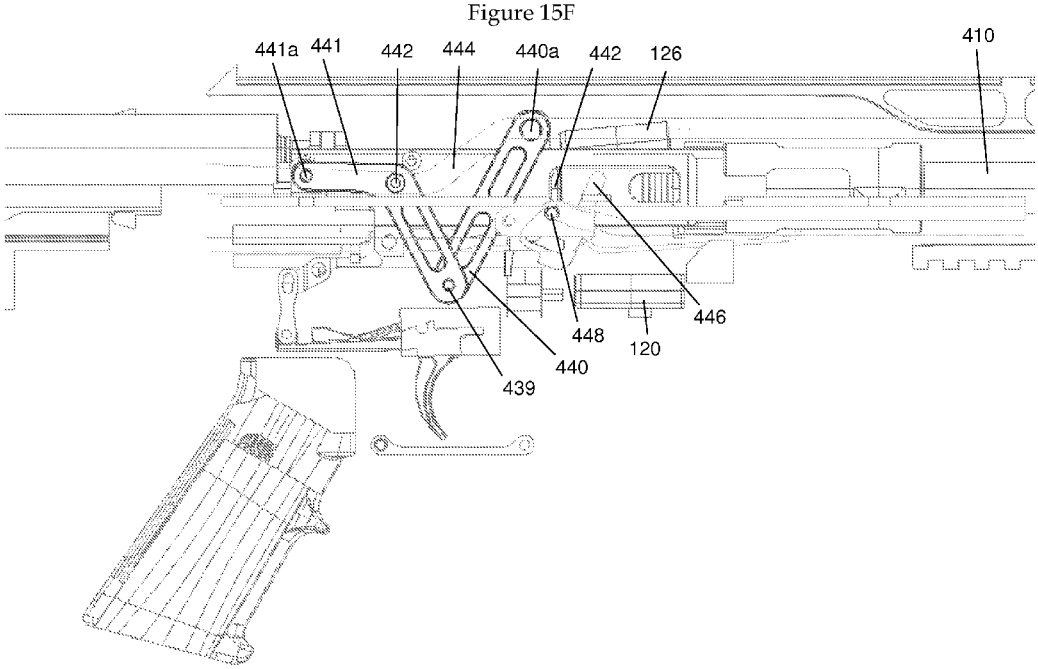
FIG. 15F is a cut-away side view of firing assembly at a sixth point of the firing cycle.

In FIG. 15F, the firing assembly 404 moves rearward. The toggles rollers 442 are guided by the toggle rail 444, rotating the rear toggles 441 about 441*a*, which then causes the forward toggles 440 to rotate about 440*a*. This motion bends the forward and rear toggles 440, 441 at the connecting joint 439 and pulls the chamber 422 open, away from the barrel 410 and back over the bolt 426. As the chamber 422 continues rearward, it contacts the firing pin lug 432 and pushes it back to the rear sear position 438*a*. A firing pin latch spring (not shown) biases the firing pin latch 438 upward, which secures the firing pin latch 438 once the lug 432 is in the rear position.

At the same time, the load pawl pivot arm 448 moves rearward into movable load pawl rail 452 to carry the load pawl through its ejection path. The movable load pawl rail 452 pivot is above the load pawl 446 pivot which causes the movable load pawl rail 452 to remain fixed due to a down rotational stop. The moveable rail 452 guides the load pawl 446 through a greater range of motion than the fixed cam 450, sweeping the load pawl 446 upward and ejecting the spent cartridge casing 126. After the spent cartridge 126 is ejected through the ejection port, which is open on charging, the load pawl rotates back down its initial sear position. As the firing assembly 404 continues rearward, the load pawl 446 moves past the ammunition well 310, allowing room for another round 120 to be presented from the magazine 502.

While the firing cycle has been described at six discrete points relating to FIGS. 15A through 15F, these six positions have been described for illustrative purposes only. It should be understood that, in operation, the present invention's firing cycle comprises a smooth and continuous sequence of motion, taking the firing assembly from sear position, to firing the round, and back to sear position.

Figure 16A:
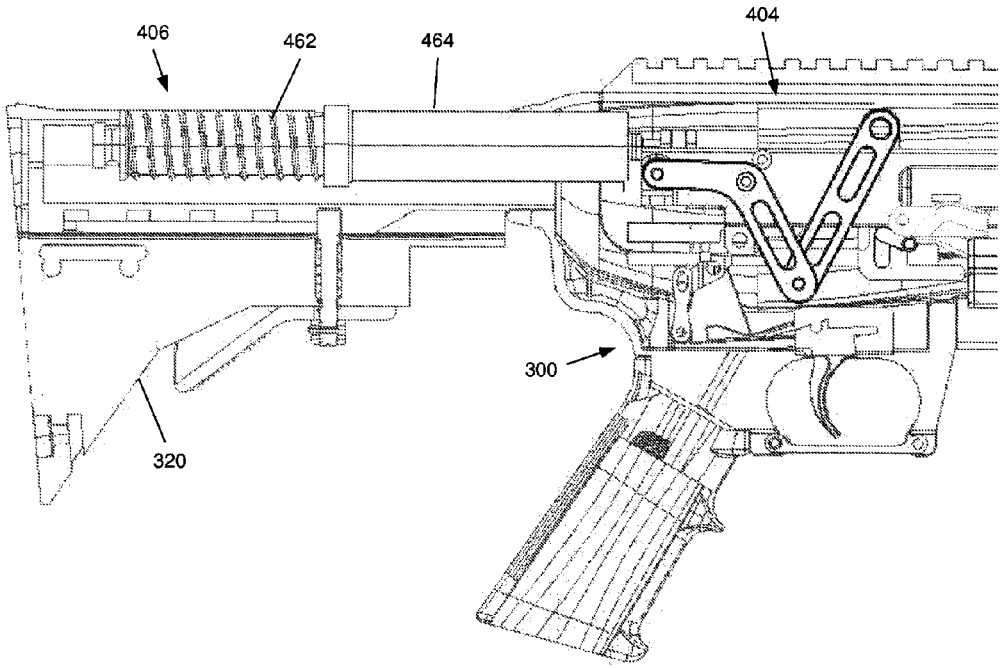
FIG. 16A is a cut-away side view revealing the recoil assembly in the sear position.
Figure 16B:
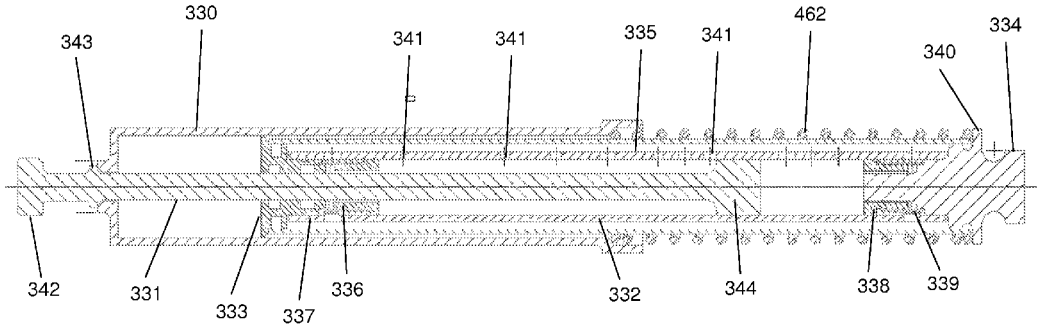
FIG. 16B is a side cross-sectional view of the recoil assembly.

Referring to FIGS. 16A and 16B, the velocity and travel distance of the barrel 410 and firing assembly 404 during recoil is regulated by the impulse averaging recoil system 406. The impulse averaging system comprises a recoiling mass, which is comprised of the mass of the moving parts of the internal operating group 400 (see FIG. 8), a drive spring 462 and a dashpot or damper 464.

The damper 464 is connected between the lower receiver 300 and the firing assembly 404 and contained within the buttstock 320 and the upper receiver internal cavity 150. The damper 464 comprises a spring retainer 330, a piston rod 331, and a buffer body 332. The spring retainer 330 is a long cylindrical tube with an open rear facing end and a closed forward end. The buffer body 332 is a cylinder with a forward end sealed by a forward end cap 333, and a rearward end sealed with a rear end cap 334. A shock tube 335 is contained within the buffer body 332 and is retained collinear with the buffer body by the forward and rear end caps. The buffer body 332 and shock tube 335 assembly is telescopically received in the open end of the spring retainer 330. The forward end cap comprises a forward shuttle valve 336 and valve spring 337, and the rearward end cap comprises a rearward shuttle valve 338 and valve spring 339. The rear end cap further releasably secures the recoil assembly to the buttstock. The spring retainer and the rear end cap comprise flanges 340 that retain the drive spring.

The buffer body and shock tube comprise hydraulic fluid. The shock tube further comprises a series of orifices 341 in its circumferential side that allow the hydraulic fluid to pass from the shock tube to the buffer body and vice versa. The piston rod 331 extends through an opening in the closed end of the spring retainer 330, through a sealed opening in the forward end cap 333 and into the shock tube 332 and past the open end of the spring retainer 330, terminating in a piston head 344. The piston rod 331 has a forward end that comprises two flanges. A first flange 342 releasably secures the recoil assembly to the barrel extension and a second flange 343 prevents the piston rod from extending too far into the spring retainer.

The damper 464 acts as a velocity regulator that controls the forward velocity of the firing assembly 404, and ensures that the weapon fires at a consistent forward velocity. The damper 464 controls the peak load on recoil by monitoring the recoil velocity and providing more resistance if the velocity is high and less if the velocity is low. The recoil system 406 of the present invention allows the weapon 100 to be fired at any attitude (+/−90° and with a large friction or impulse variation from the round 120.

When the weapon is charged, the recoil assembly is compressed, the spring 462 is compressed, the shock tube 335 and buffer body 332 are pushed into the spring retainer, and the piston rod 331 is deeply extended into the shock tube 335. This orientation places a high percentage of the hydraulic fluid forward of the piston rod head 344 and little to no hydraulic fluid rearward of the piston rod head. When the trigger is pulled, the main spring 462 pushes the spring retainer 330, piston 344, and barrel extension forward. While moving forward, the piston pushes on the hydraulic fluid. The bulk of the hydraulic fluid moves from forward of the piston head 344 through the shock tube orifices 341 axially along the outer surface of the shock tube, between the shock tube 335 and buffer body 332, and back into the shock tube through more orifices, rearward of the piston head.

As the piston moves forward, there are fewer and fewer orifices for the piston to push hydraulic fluid through, this results in a gradual reduction of flow area controlled by the fixed orifices. Also, the spring loaded shuttle valve 336 in the forward end cap 333 initially remains open presenting a large flow area. When the differential pressure across the valve exceeds the spring pressure, the shuttle valve 336 closes to greatly reduce the flow area. The combination of reduction of the fixed orifices and the shuttle valve orifice closing, creates greater resistance to fluid flow and therefore a greater resistance to the forward motion of the barrel extension. The fixed orifices 341 and the shuttle valve 336 and spring 462 are designed such that the forward momentum of the barrel extension remains constant, independent of external forces such as gravity or increase mechanical resistance such as friction.

Once the weapon fires, the barrel extension moves rearward driven by momentum of the fired round minus the forward motion momentum. The piston 344 once again pushes the hydraulic fluid. The bulk of the hydraulic fluid moves from rearward of the piston head through the fixed orifices 341 axially along the outer surface of the shock tube 335, between the shock tube and buffer body 332, and back into the shock tube, through more fixed orifices 341, forward of the piston head. As the piston moves rearward, there are fewer and fewer orifices for the piston to push hydraulic fluid through, this results in a gradual reduction of flow area controlled by the fixed orifices. The rear spring loaded shuttle valve 338 in the rearward end cap 334 initially remains open presenting a large flow area. When the differential pressure across the valve exceeds the spring pressure, the shuttle valve closes to greatly reduce the flow area. The combination of reduction of the fixed orifices and the shuttle valve orifice closing, creates greater resistance to fluid flow and therefore a greater resistance to the rearward motion of the barrel extension. The fixed orifices 341 and the shuttle valve 338 and spring 462 are designed such that the rearward momentum of the barrel extension remains constant, independent of external forces such as gravity or increase mechanical resistance such as friction. It also is design to minimize the load to approximately 33 lbf with a large range of ammunition round impulse variation. Additional embodiments of recoil systems are described in U.S. Pat. Nos. 6,343,536 and 6,644,168, each of which is hereby incorporated by reference in its entirety.

Figure 17:
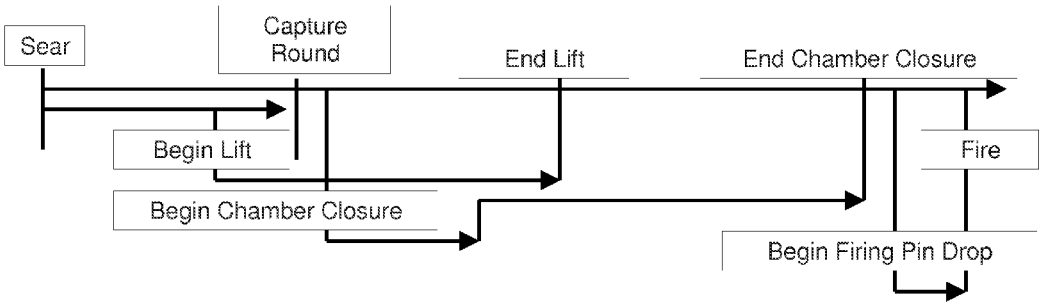
FIG. 17 is a schematic diagram detailing the processes of the firing cycle.
Figure 18:
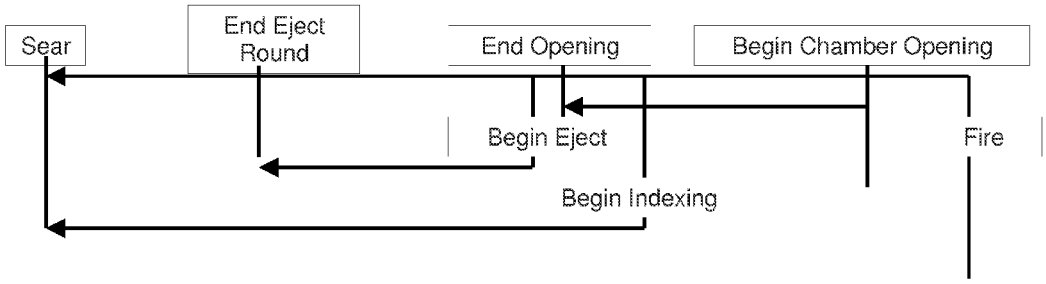
FIG. 18 is a schematic diagram detailing the processes of the recoil cycle.

FIG. 17 is a diagrammatic representation of the counter recoil cycle as the operating group moves from the fully retracted, ready to fire, Sear position to the fully forward Fire position. FIG. 18 shows the recoil cycle as the operating group moves from the fully forward, Fire position to the fully retracted, Sear position. Assuming that the Sear position defines the origin of movement or zero position, in a preferred embodiment, the steps of the counter recoil cycle occur at approximately the following distances from the Sear position: Sear at 0.0 in.; Begin Lift at 0.65 in.; Begin Chamber Closure at 0.65 in.; Capture Round at 0.75 in.; End Lift at 1.15 in.; End Chamber Closure at 2.05 in.; Begin Firing Pin Drop at 2.29 in.; and Fire at 2.3 in. The steps of the recoil cycle occur at approximately the following distances from the Sear position: Fire at 2.3 in.; Begin Chamber Opening 2.05 in.; Begin Indexing at 1.3 in.; End Opening at 1.15 in.; Begin Eject at 1.1 in.; End Eject Round at 0.5 in.; and Sear at 0.0 in. Alternatively, these distances can be adjusted or rearranged in accordance with the knowledge of one skilled in the art.

In the embodiments described herein, the rounds enter the cycle from the bottom and exits from the top. Unlike known weapons where one round must be removed before the next round can be fed, feeding a round into the weapon will force out any rounds remaining in the breech opening. This prevents multiple feed issues during misfires and immediate action. A misfire requires only recharging the weapon which positively clears the round out of chamber and the feed path. These features provide a more reliable weapon in the field and easier operator training.

Figure 19:
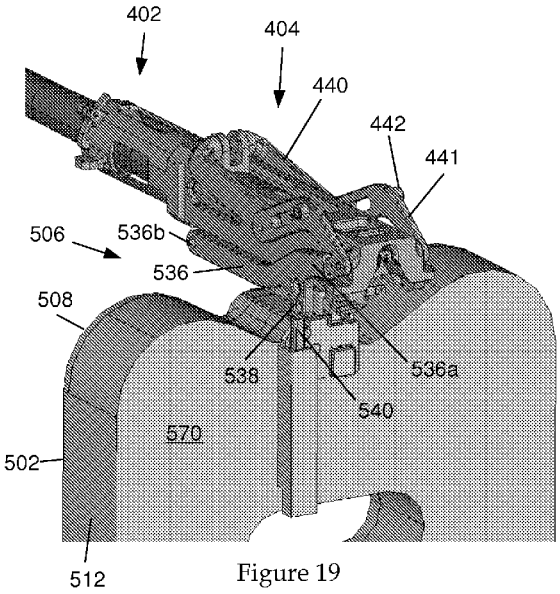
FIG. 19 is a perspective view of the linkless ammunition feed system.
Figure 20:
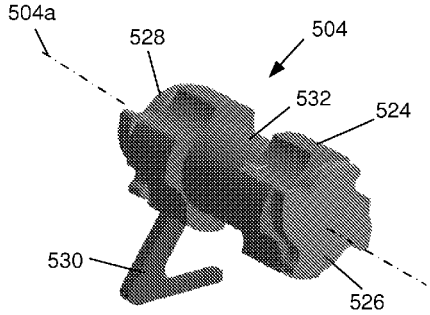
FIG. 20 is a perspective view of the feed sprocket.
Figure 21:
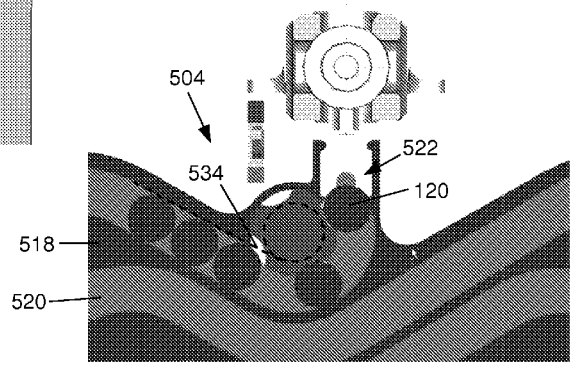
FIG. 21 is a cross-sectional view of the ammunition container.

Referring now to FIGS. 19-21, the preferred embodiment further comprises a linkless ammunition feed system 500. The ammunition feed system 500 comprises an ammunition container 502, a feed sprocket assembly 504, and a feed actuation assembly 506.

In the preferred embodiment, The ammunition container 502 is a two-piece design having a front portion 508 and a rear portion 510. Container sidewalls 512 may be integrally formed with either the front 508 or rear 510 portions, or both. The ammunition container 502 has a capacity of 150 rounds of ammunition, though higher or lower capacities containers 502 are possible. The container 502 may be made from glass and PTFE filled nylon or other appropriate material. A translucent or clear material preferably forms the rear portion 510, allowing the operator to view the number of rounds remaining in the container.

The ammunition container 502 further comprises parallel front and rear interior surfaces with one or more interior walls 518 extending orthogonally between the front and rear interior surfaces. A space is provided between the interior walls 518 to form an ammunition path 520. In the preferred embodiment, the interior walls 518 cooperate to form a single, convolute ammunition path 520 beginning at some position within the container 502 and terminating at a discharge opening 522 and feed sprocket assembly 504. Embodiments of the ammunition path 520 extend in a generally spiraling coiled layout with no sharp turns or corners. However, the ammunition path 520 can be configured in any shape or layout that allows the ammunition to freely feed through the path 520 as the weapon 100 is fired. The ammunition container 502 also comprises a discharge opening 522 to allow the ammunition rounds 120 to pass from the ammunition container 502 into the cavity 150 created by the upper and lower receivers 200, 300 for presentation to the load pawl 446.

The feed sprocket assembly 504 is attached to the ammunition container at the discharge opening 522 and comprises a feed sprocket 524, a drive wheel 526, a back drive wheel 528 and pawl 530, a spool 532, and a feed cable 534. The feed sprocket 524, drive wheel 526, back drive wheel 528 and pawl 530, and spool 532 are linearly arranged and rotate about the same axis of rotation 504*a*, and also rotate in unison. The spool 532 acts as a spool to collect the feed cable 534. The feed sprocket 524 and back drive wheel 528 are positioned at one end of the spool 532, while the drive wheel 526 is positioned at the opposite end. The feed cable 534 is preferably made of steel or another material of appropriate strength. One end of the cable 534 is attached to a cylindrical pusher (not shown), which pushes the ammunition rounds 120 through the ammunition path 520 as the feed cable 534 is taken-up by the spool 532. The feed cable 534 collects on the spool 532 in a single layer to prevent pitch change. This ensures that one of rotation of the spool 532 will consistently correspond to a linear displacement of a single round of ammunition 120, regardless of the location of the last round within the ammunition path 520. This also ensures that the feed sprocket 524 is continually supplied with the next available round 120. The feed cable is threaded from the spool 532 through the ammunition path 520 on the outside of the rounds 120. As the cable 534 is fed through the ammunition path 520 during firing cycles, the rounds 120 serve as low friction bearings allowing the cable to turn the corners in the ammunition container and not bind.

As the drive wheel 526 rotates, the feed sprocket 524 and spool 532 also rotate, winding the feed cable 534 about the spool 532. As the feed cable 534 is taken up on the spool 532, it pulls the cylindrical pusher through the ammunition path 520. The cylindrical pusher pushes all preceding rounds of ammunition through the ammunition path toward the discharge opening 522 and feed sprocket 524. Thus, eliminating the need to link the rounds of ammunition together. As each individual round of ammunition 120 approaches the feed sprocket 524, the teeth of the sprocket 524 engage the round 120. As the sprocket 524 continues to rotate, it lifts the round 120 into the receiver cavity for presentation to the load pawl 446. The back drive wheel 528 and back drive pawl 530 ensure that the feed sprocket 524 and spool 532 will not reverse rotation during the weapon firing cycle.

The feed system 500 also comprises a driving slide 536 and pushrod 540. The pushrod 540 is slidably attached to the ammunition container 502 and is biased in an extended or up position by a return spring (not shown). The pushrod 540 comprises a pawl to engage with and turn the drive wheel 526.

The driving slide 536 is an elongated member, with a first end **536*b* pivotally connected to the interior surface 201 of the upper receiver 200 and a second, distal end 536*a*. The driving slide 536 further comprises a tappet 538 on its underside, at the distal end 536*a*. The length of the driving slide is sufficient that the distal end 536*a* and tappet 538 move in a generally linear and vertical fashion when the slide 536** pivots.

When the driving slide 536 and pushrod 540 are in their initial position, they are biased upward by the spring 544. As the firing assembly 404 moves rearward during the recoil or while the weapon is being charged, a feed system cam or roller on the barrel extension 420 engages with the driving slide 536 to force it to pivot, moving the tappet 538 downward. The tappet 538 forces the pushrod 540 down, compressing the return spring 544. As the pushrod 540 is driven down, the drive pawl 542 engages and turns the drive wheel 526, which sets the spool and feed sprocket in motion as described herein, presenting a round 120 to the load pawl 446.

With the weapon 100 now in the sear position, the trigger 304 is pulled (or if the trigger 304 remains pulled when the weapon is in its automatic setting) and the firing assembly 404 moves forward, the feed system cam/roller moves away from the driving slide 536, allowing the return spring 544 to return the pushrod 540 and driving slide 536 to their initial position. This also places the drive pawl 542 in a position to turn the drive wheel 526 during the next cycle. Another variation provides the driving slide 536 with a spring to assist in returning it to its initial position.

It should be noted that the weapon 100 is also capable of utilizing a number of different ammunition containers 502. An alternative embodiment comprises a conventional, single column, ammunition magazine capable of holding twenty-five ammunition rounds 120.

Figure 22:
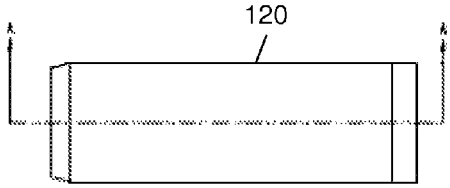
FIG. 22 is a top view of the ammunition round of the present invention.
Figure 23:
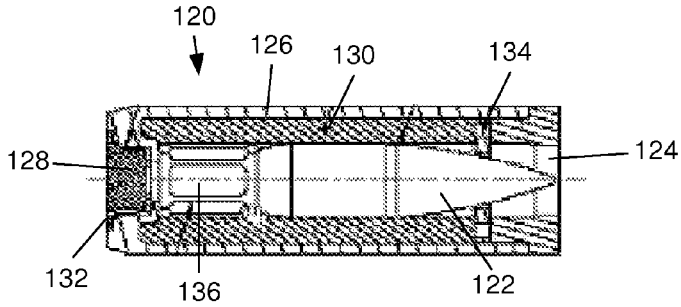
FIG. 23 is a cross-sectional side view of the ammunition round of the present invention.
Figure 24:
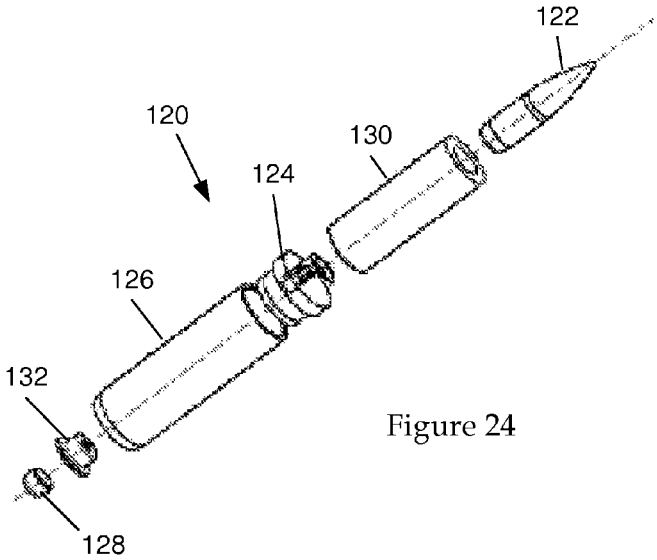
FIG. 24 is an perspective and exploded view of the ammunition round of the present invention.

As illustrated in FIGS. 22-24, a preferred embodiment of the weapon utilizes a substantially cylindrical ammunition round 120. The round 120 comprises a bullet or ball 122, a forward cap 124, a cartridge case 126, a primer 128, a propellant charge 130, a primer retainer 132, a retainer ring 134, and a stand-off spacer 136.

It will be apparent to those skilled in the art that various modifications and variations can be made in the method of manufacture of the present invention and in construction of this automatic recoil operated weapon without departing from the scope or spirit of the invention. Embodiments of the invention are intended for use in multiple weapon configurations utilizing various ammunition calibers and fulfilling a variety of purposes. For example, possible configurations include, but are not limited to, light machine guns, long and short automatic rifles, and carbines.

Other embodiments of the invention will be apparent to those skilled in the art from consideration of the specification and practice of the invention disclosed herein. It is intended that the specification be considered as exemplary only.

The invention claimed is:

1. An ammunition feed system for a firearm comprising:

an ammunition container, the ammunition container comprising a path for holding a plurality of ammunition rounds in a single file manner and an exit for passing the ammunition rounds out of the container;

a pusher positioned in and adapted to freely slide through the ammunition path, the plurality of ammunition rounds being positioned between the exit and the pusher, the pusher adapted to push the ammunition toward the exit;

a feed line connected to the pusher and extending through the ammunition path;

a rotatable feed line spool adapted to collect the feed line;

a feed sprocket attached to and collinear with the feed line spool, the feed sprocket comprising radially spaced teeth;

wherein, when the feed sprocket rotates, the teeth engage and move an ammunition round from the container exit to a firearm associated with the ammunition feed system.

2. The ammunition feed system of claim 1 wherein, the feed line has an appropriate cross section to allow the feed line and the plurality of ammunition rounds to move freely within the ammunition path.

3. The ammunition feed system of claim 1 wherein, the feed sprocket turns in unison with the feed line spool.

4. The ammunition feed system of claim 3 further comprising a drive wheel connected with the feed sprocket to drive the rotational movement of the feed sprocket, wherein the drive wheel comprises teeth.

5. The ammunition feed system of claim 3 further comprising a back drive wheel connected with the feed sprocket.

6. The ammunition feed system of claim 5 further comprising a pivoting back drive pawl, wherein the back drive wheel and back drive pawl allow rotation of the feed line spool and feed sprocket in a first direction and prevent significant rotation of the feed sprocket in a second direction.

7. The ammunition feed system of claim 5 further comprising a pushrod, wherein the pushrod comprises a first end and a second end, and the pushrod first end engages a drive wheel tooth to turn the drive wheel when the pushrod moves.

8. The ammunition feed system of claim 7 wherein, the pushrod is adapted for linear movement.

9. The ammunition feed system of claim 8 further comprising a pushrod spring to bias the pushrod in a direction away from the drive wheel.

10. The ammunition feed system of claim 7 further comprising a driving slide, the driving slide being connected to a firearm associated with the ammunition feed system and adapted for movement in response to a recoil cycle of the firearm.

11. The ammunition feed system of claim 10 wherein, the driving slide is adapted to contact the second end of the pushrod to drive the movement of the pushrod.

12. An ammunition feed system for a firearm comprising:

an ammunition container, the ammunition container comprising a path for holding a plurality ammunition rounds in a single file manner and an exit for passing the ammunition rounds out of the container;

a pusher positioned in and adapted to freely move through the ammunition path, the plurality of ammunition rounds being positioned between the exit and the pusher, the pusher adapted to push the ammunition toward the exit;

a feed line connected to the pusher and extending through the ammunition path;

a rotatable feed line spool;

wherein the feed line spool rotates through a predetermined angle of rotation for each firing cycle of the firearm.

13. The ammunition feed system of claim 12 wherein, as the feed line spool rotates through a predetermined angle, it spools a length of feed line sufficient to move the plurality of ammunition rounds forward in the ammunition path by one round.

14. The ammunition feed system of claim 12 wherein, the feed line has a substantially circular cross section.

15. The ammunition feed system of claim 12 wherein, the feed line has an elongated cross section in which the height of the feed line is less than the width of the feed line.

16. The ammunition feed system of claim 12 further comprising a feed sprocket attached to and collinear with the feed line spool, the feed sprocket comprising radially spaced teeth;

wherein, when the feed sprocket rotates, the teeth engage and move an ammunition round from the container exit to a firearm associated with the ammunition feed system.

17. The ammunition feed system of claim 16 further comprising a drive wheel connected with the feed sprocket to drive the rotational movement of the feed sprocket, wherein the drive wheel comprises teeth.

18. The ammunition feed system of claim 17 further comprising a pushrod, wherein the pushrod comprises a first end and a second end, and the pushrod first end engages a drive wheel tooth to turn the drive wheel when the pushrod moves.

19. The ammunition feed system of claim 18 further comprising a driving slide adapted to contact the second end of the pushrod to drive the movement of the pushrod, the driving slide being connected to a firearm associated with the ammunition feed system and adapted for movement in response to a recoil cycle of the firearm.

* * * * *